US012139985B2

(12) United States Patent
Brubacher et al.

(10) Patent No.: US 12,139,985 B2
(45) Date of Patent: Nov. 12, 2024

(54) CONTINUOUS SAMPLING DRILL BIT

(71) Applicant: VERACIO LTD., Salt Lake City, UT (US)

(72) Inventors: Adrian Brubacher, North Bay (CA); Christopher L. Drenth, Callander (CA)

(73) Assignee: Veracio Ltd., Salt Lake City, UT (US)

( * ) Notice: Subject to any disclaimer, the term of this patent is extended or adjusted under 35 U.S.C. 154(b) by 0 days.

(21) Appl. No.: 18/073,873

(22) Filed: Dec. 2, 2022

(65) Prior Publication Data

US 2023/0175334 A1 Jun. 8, 2023

Related U.S. Application Data

(60) Provisional application No. 63/285,844, filed on Dec. 3, 2021.

(51) Int. Cl.
*E21B 25/10* (2006.01)
*E21B 10/02* (2006.01)

(52) U.S. Cl.
CPC ..... *E21B 25/10* (2013.01); *E21B 10/02* (2013.01)

(58) Field of Classification Search
CPC ..... E21B 25/10; E21B 10/02; E21B 10/04
See application file for complete search history.

(56) References Cited

U.S. PATENT DOCUMENTS

| | | | | |
|---|---|---|---|---|
| 3,084,752 | A * | 4/1963 | Tiraspolsky | E21B 10/04 175/269 |
| 3,086,602 | A * | 4/1963 | Henderson | E21B 10/04 175/324 |
| 4,168,755 | A | 9/1979 | Willis | |
| 4,694,916 | A * | 9/1987 | Ford | E21B 10/04 175/252 |
| 10,626,676 | B1 | 4/2020 | Drenth et al. | |
| 2015/0368976 | A1 | 12/2015 | Langford et al. | |
| 2017/0362900 | A1 * | 12/2017 | Pearce | E21B 10/61 |

FOREIGN PATENT DOCUMENTS

| | | |
|---|---|---|
| CN | 102536123 A | 7/2012 |
| CN | 212249848 U | 12/2020 |

OTHER PUBLICATIONS

International Search Authority Search Report and Written Opinion for corresponding PCT Application No. PCT/US 22/51636, dated Mar. 1, 2023.

* cited by examiner

*Primary Examiner* — Catherine Loikith
(74) *Attorney, Agent, or Firm* — Ballard Spahr LLP

(57) ABSTRACT

A drill bit can be configured to form core segments during drilling. The drill bit can have having a central axis and a shank defining an inner bore. A crown can be coupled to the shank. The crown can define a cutting face and a core receiving slot that extends inwardly into the crown from the cutting face. The crown can define an inner operative circumference. A core break structure can be disposed within the shank. The core break structure can define a core break surface that extends inwardly toward the central axis and intersects an imaginary 3D projection of the inner circumference projected along the central axis.

16 Claims, 20 Drawing Sheets

CONTINUOUS SAMPLING DRILL BIT

CROSS-REFERENCE TO RELATED APPLICATION

This application claims priority to U.S. Provisional Application No. 63/285,844, filed Dec. 3, 2021, the entirety of which is hereby incorporated by reference herein.

FIELD

This disclosure relates to drill bits for forming core or rock samples during drilling, and systems and methods of using such drill bits.

BACKGROUND

Conventionally, core sampling requires a wireline assembly for retrieving a cylindrical core sample drilled by a core sampling bit. Such core sampling is a time consuming and intensive process that requires complex wireline tooling. Accordingly, a need exists for a sampling method that eliminates wireline tooling and does not require that drilling be stopped to permit separation of samples from the formation or to retrieval of samples. Continuous sampling methods that use percussive pneumatic hammers are limited to non-water-bearing (dry) formations, require air circulation, have high energy consumption, and suffer from further limitations of percussive drill bits.

SUMMARY

Described herein, in various aspects, is a drill bit configured to form core segments during drilling. The drill bit can have a central axis. The drill bit can comprise a shank defining an inner bore. A crown can be coupled to the shank. The crown can define a cutting face and a core receiving slot that extends inwardly into the crown from the cutting face. The crown can define an inner operative circumference. A core break structure can be disposed within the shank. The core break structure can define a core break surface that extends inwardly toward the central axis and intersects an imaginary 3D projection of the inner circumference projected along the central axis.

In some aspects, a drilling assembly can comprise a drill rod defining an inner bore; and a drill bit as disclosed herein. The shank of the drill bit can be threadedly coupled to the drill rod.

In some aspects, a drilling assembly can comprise a drill bit having a central axis. The drill bit can comprise a shank defining an inner bore. A crown can be coupled to the shank. The crown can define a cutting face and a core receiving slot that extends inwardly into the crown from the cutting face. The crown can define an inner operative circumference. A drill string component can be coupled to the drill bit. The drilling assembly can comprise a core break structure that defines a core break surface that extends inwardly toward the central axis and intersects an imaginary 3D projection of the inner circumference projected along the central axis.

Described herein, in various aspects, is a drill bit configured to form core segments during drilling. The drill bit can have a central axis. The drill bit can comprise a shank defining an inner bore. A crown can be coupled to the shank. The crown can define a cutting face and a core receiving slot that extends inwardly into the crown from the cutting face. The crown can define an inner operative circumference. A core break structure can be disposed within the shank. The core break structure can define a core break surface that extends inwardly toward the central axis and intersects an imaginary 3D projection of the inner circumference projected along the central axis. At least one axial conduit can be radially spaced from the central axis and can extend through the drill bit to provide fluid communication from the shank to the cutting face. At least one face channel can extend from the core receiving slot and intersects a respective axial conduit of the at least one axial conduit.

A method can comprise advancing a drilling assembly as described herein into a formation to form drilling cuttings and core segments.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
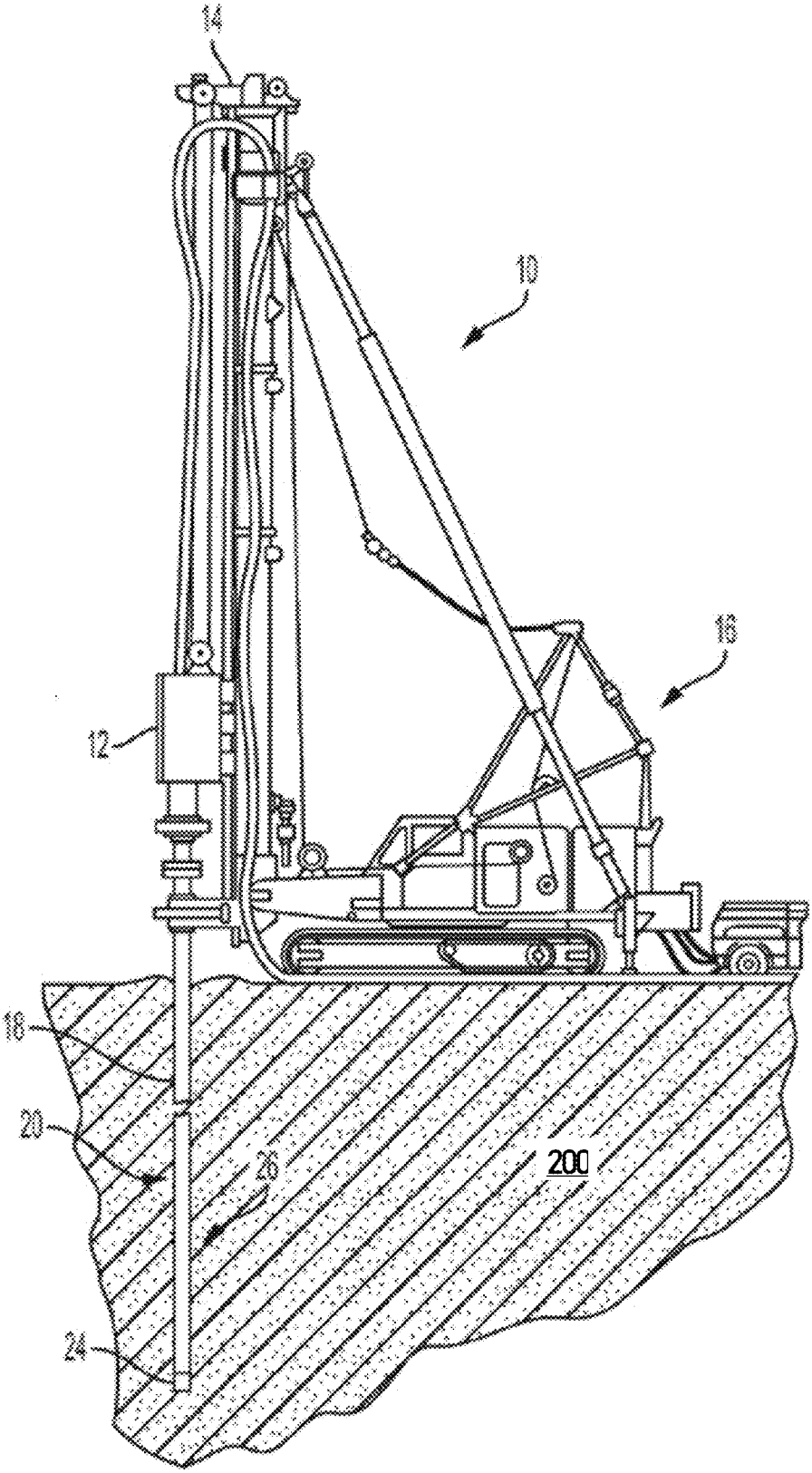
FIG. 1 is a drill rig operating drilling assembly in accordance with embodiments disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a crown portion" can refer to one or more of such crown portions, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

The word "or" as used herein means any one member of a particular list and, except where otherwise indicated, can also include any combination of members of that list.

As used herein, the term "at least one of" is intended to be synonymous with "one or more of." For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, if further aspects, when values are approximated by use of "approximately," "substantially," and "generally," it is contemplated that values within up to 15%, up to 10%, up to 5%, or up to 1% (above or below) of the particularly stated value can be included within the scope of those aspects. In still further aspects, when angular relationships (e.g., "parallel" or "perpendicular") are approximated by use of "approximately," "substantially," or "generally," it is contemplated that angles within 15 degrees (above or below), within 10 degrees (above or below), within 5 degrees (above or below), or within 1 degree (above or below) of the stated angular relationship can be included within the scope of those aspects.

As used herein, the term "proximal" refers to a direction toward a drill rig or drill operator and generally opposite a direction of drilling (and away from a formation or borehole), while the term "distal" refers to a direction away from the drill rig or drill operator and generally in the direction of drilling (and into a formation or borehole).

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

According to various aspects, the devices, systems, and methods disclosed herein can be used in continuous sampling of a formation. That is, formation samples, comprising relatively small cuttings and/or larger core segments (further described herein), can be retrieved as the formation is drilled using reverse circulation. The formation samples can be tested and inspected in order to determine the makeup and various other information regarding the formation (e.g., information conventionally determined via core samples retrieved via conventional wireline). In contrast to conventional wireline core sampling, the disclosed devices, systems, and methods enable samples to be collected while drilling, greatly increasing sampling rate. Additionally, it is contemplated that the samples can be associated with the depth at which they were collected. That is, the time delay between the depth at which the samples were removed from the formation and subsequently pumped from the proximal end of the borehole and collected can be accounted for (e.g., using a known rate of travel of the samples at a given flow rate).

Further, the samples can be formed with sizes relative to the dimensions of the interior of the drill string so that samples cannot pass each other as they travel proximally out of the hole. Thus, the samples can remain in the same order in which they are broken from the formation. Accordingly, samples can, once returned to the surface, be arranged in order in which they are received and aligned end-to-end to provide a continuous core sample. In some aspects, the samples can have a short enough length to allow tumbling about their central axis. In some aspects, the samples can be long enough that the samples cannot tumble. In this way, the samples maintaining the same longitudinal orientation as that they were before separation from the formation. That is, when returned to the surface, the proximal and distal ends of the core sample can be determined. In further aspects, samples can be broken in lengths that permit tumbling end-over-end, thereby minimizing likelihood of jamming.

Disclosed herein, with reference to FIG. 1, is a drill bit for use with a drilling system 10 that includes a drill head 12. The drill head 12 can be coupled to a mast 14 that, in turn, is coupled to a drill rig 16. The drill head 12 can be configured to have one or more tubular threaded members 18 coupled thereto. Tubular members 18 can include, without limitation, drill rods, casings, and down-the-hole hammers (e.g., fluid-driven or magnetically-driven hammers). Optionally, in some aspects, use of embodiments disclosed herein can eliminate a need for down-the-hole hammers. For ease of reference, the tubular members 18 are described herein as drill string components. Each drill string component 18 can in turn be coupled to additional drill string components 18 to form a drill or tool string 20. In turn, the drill string 20 can be coupled at a distal end to a drill bit 24, such as a rotary drill bit, core sampling drill bit (e.g., diamond-impregnated core sampling bit), or percussive bit, configured to interface with the material, or formation 200, to be drilled. The drill bit 24 can form a borehole 26 in the formation 200. According to some implementations, the drill bit 100 can include a reverse circulation continuous sampling drill bit 100, such as those depicted and described in relation to FIGS. 2-4.

In reverse circulation systems, a pressurized fluid is pumped through (e.g., down) the borehole 26 (in a distal direction). The fluid can be pumped through (e.g., down) an outer annulus, such as, for example, a space between the borehole 26 and the outer wall of the drill string 20. The fluid can then return (in a proximal direction) through an interior of the drill string 20. In reverse circulation drilling, the returning fluid can provide fluid pressure to move certain components or materials in a proximal direction along (optionally, up) the drill string. As disclosed herein, the returning fluid can carry core sample bits in a proximal direction along (optionally, up) the drill string and to the borehole outlet. Further aspects of reverse circulation systems are disclosed in United States Application Publication No. 2020/0003021 (U.S. patent application Ser. No. 16/486,216) to BLY IP INC., filed Feb. 13, 2018, which is hereby incorporated herein in its entirety. The reverse circulation system can exclude air circulation, which can be beneficial in water-bearing formations in which air cannot be circulated. Because fluid can be passed around the outer wall of the drill string 20, dual-tube drill strings may not be required. That is, in some aspects, and as further described herein, the drill string may only comprise a single tube that is coupled to the drill bit 100. However, according to further aspects, it is contemplated that dual-tube drill strings can be used under conditions where the ground/formation is not suitable for acting as an outer wall of a conduit through which fluid can be pumped (e.g., porous or soft ground conditions).

Figure 2:
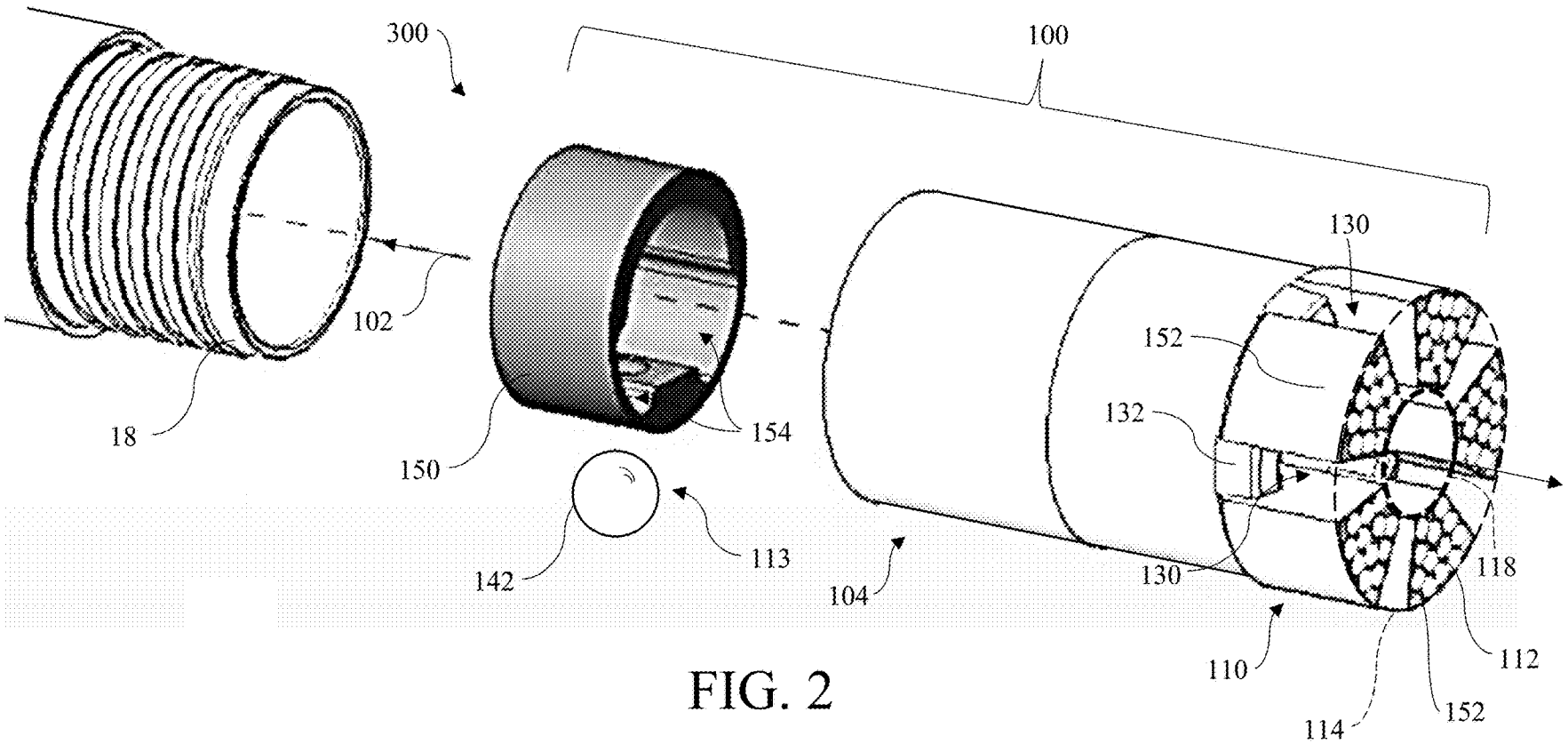
FIG. 2 is an exploded view of a drilling assembly comprising a drill bit as disclosed herein.
Figure 3:
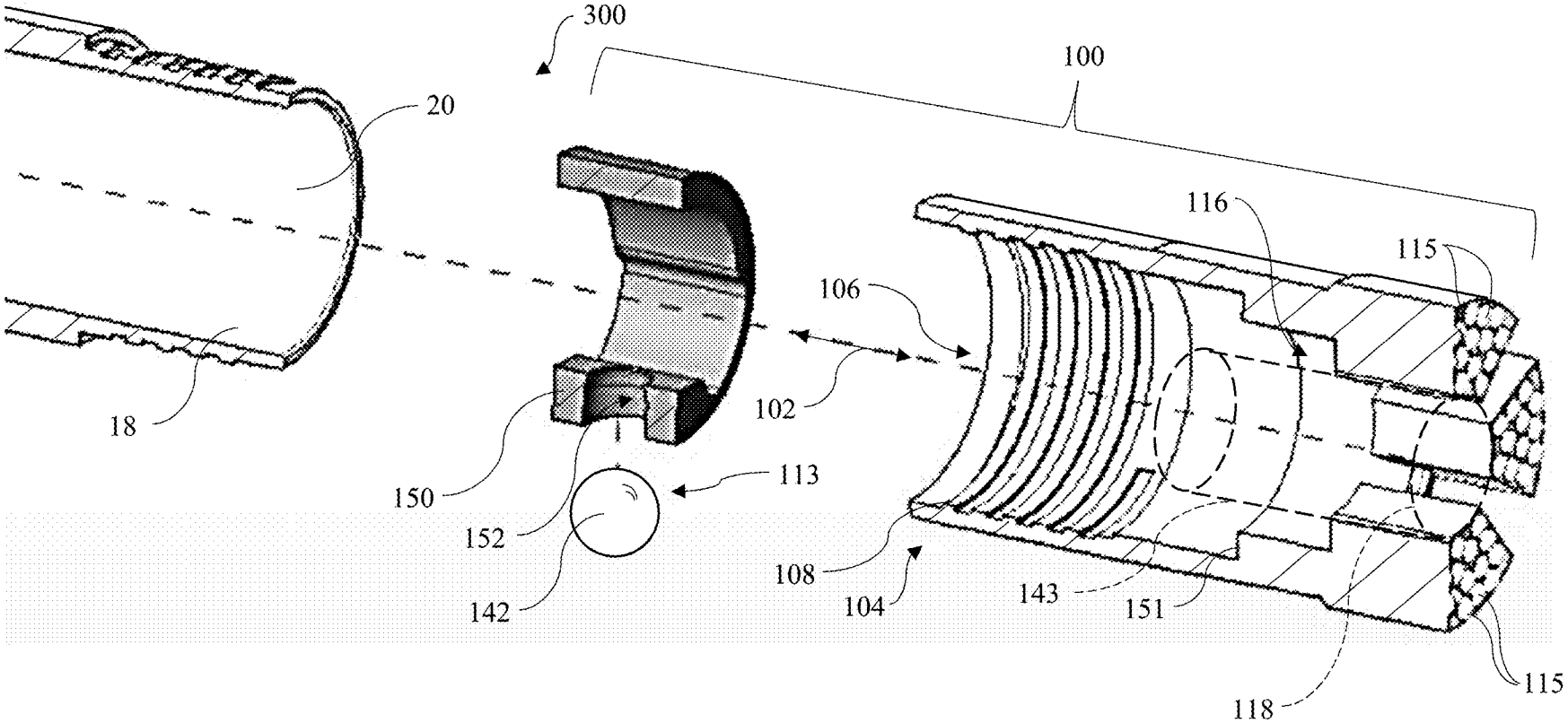
FIG. 3 is a sectional view of the exploded view of FIG. 2, taken in a plane that extends through a longitudinal axis of the drilling assembly.
Figure 4:
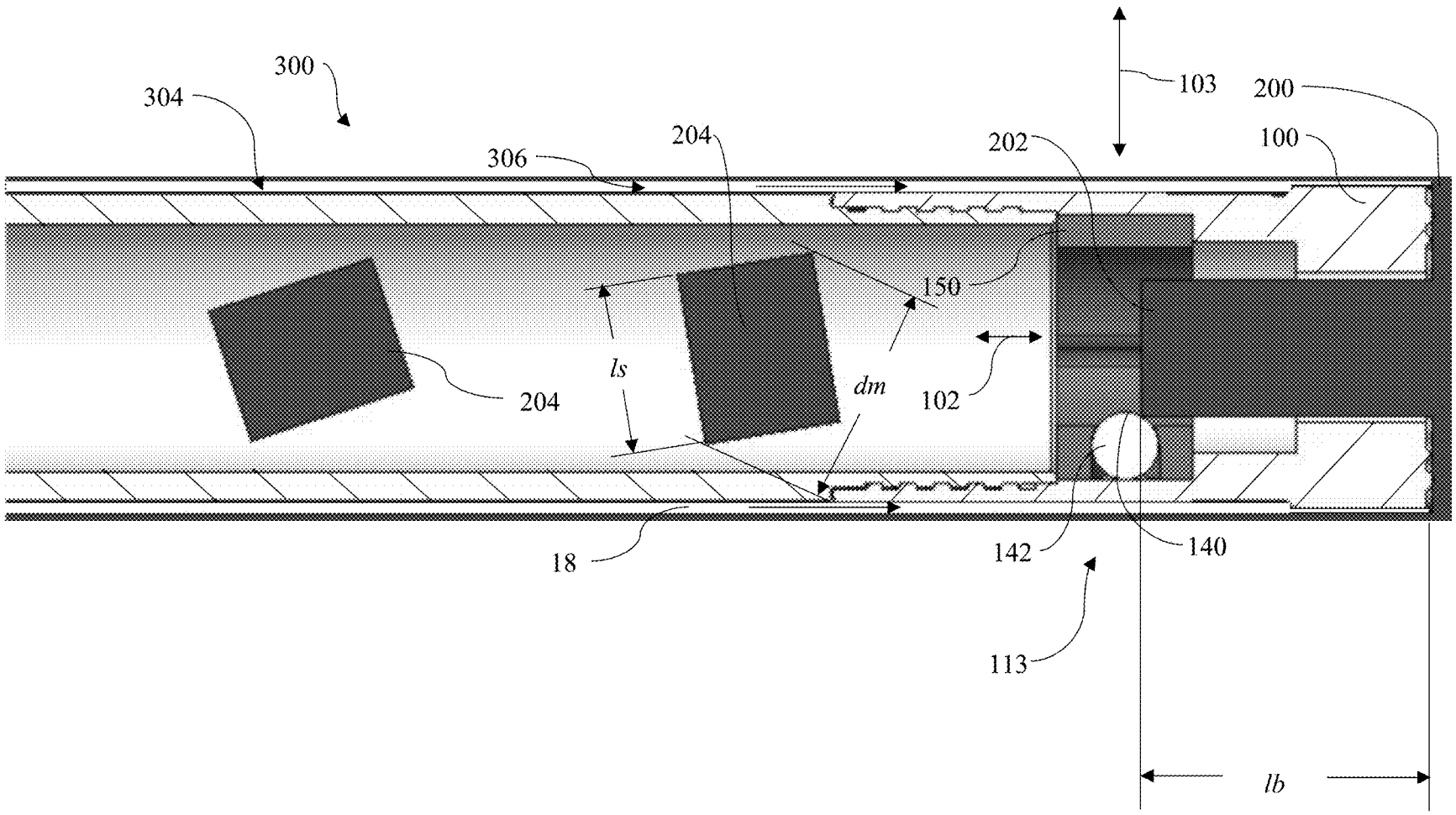
FIG. 4 is a cross-sectional view of the drilling assembly of FIG. 2 being advanced through a formation and forming core segments.

In various aspects and with reference to FIGS. 2-4, the drill bit 100 can have a central axis 102. The drill bit 100 can comprise a shank 104 defining an inner bore 106. The shank 104 can define at least one thread 108 (e.g., one or more female threads) that are configured to couple to the drill string 20 (FIG. 1).

The drill bit 100 can further comprise a crown 110, which can have a cutting face 112 that defines an outer operative circumference 114 (FIG. 2). An operative circumference can be defined as a continuous pathway (e.g., a circular or round pathway), formed within a plane that is perpendicular to the central axis 102, by tracing and connecting respective portions of the inner surfaces or outer surfaces of the crown. Thus, the operative circumference simulates a boundary or perimeter that would exist if the inner or outer surface of the crown extended continuously (without interruption) over 360 degrees. Accordingly an outer operative circumference can circumscribe an outer surface of the crown, and an inner operative circumference can inscribe one or more inner surfaces of the crown at the cutting face.

The crown 110 can comprise a core receiving slot 116 in communication with the inner bore 106 of the shank 104. The core receiving slot 116 can extend inwardly into the crown from the cutting face. The crown 110 can define an inner operative circumference 118. That is, as the bit rotates, the cutting face 112 of the drill bit 100 can define an inner area within which the cutting face 112 does not engage the formation as the drill bit advances. Accordingly, as the drill bit 100 advances into a formation 200, a portion 202 of the formation within the inner operative circumference 118 can remain intact with the rest of the formation and extend inwardly into the core receiving slot 116. Optionally, in some aspects, the area of the inner operative circumference 118 can range from about 5 square centimeters to about 18 square centimeters in cross section. In still further aspects, the inner operative circumference 118 can have a diameter ranging from about 5 mm to about 40 mm, or from about 8 mm to about 25 mm. In further aspects, the inner operative circumference can have a diameter of less than 5 mm or greater than 40 mm.

The drill bit 100 can comprise a core break structure 113 disposed within the shank 104. The core break structure 113 can define a core break surface 140 that extends radially inwardly toward the central axis 102 and intersects an imaginary/invisible three-dimensional (3D) projection 143 of the inner operative circumference 118 projected along the central axis. As used herein, the term "imaginary" indicates that the described element is not visible; rather, the imaginary element is intended to define provide a frame of reference for describing the relative position (e.g., relative radial or transverse position) of various features of the disclosed drill bits. In some aspects, the core break surface 140 extends across only a portion of the projection 143 of the inner operative circumference 118 projected through the drill bit 100 along the central axis 102. Thus, in some aspects, the core break surface 140 can extend into said 3D projection 143 of the inner operative circumference 118 (from outside of the 3D projection 143) transversely by less than the diameter of the inner operative circumference 118 (e.g., along a transverse axis 103 that is perpendicular to, or generally perpendicular to, the central axis 102). In some aspects, the central axis 102 does not extend through the core break surface 140.

The core break surface 140 can extend into the imaginary 3D projection 143 by from about 0.8 mm to about 2 mm along the transverse axis 103, or from about 1 mm to about 1.5 mm along the transverse axis 103. The core break surface 140 can extend into the 3D projection 143 along the transverse axis 103 by a distance corresponding to from about 3% to about 10% of the diameter of the inner operative circumference 118, or from about 5% to about 7% of the diameter of the inner operative circumference, or about 5% of the diameter of the inner operative circumference, or less than 15% of the diameter of the inner operative circumference. In exemplary aspects, for a 1 inch diameter inner operative circumference, and a 1.25 inch long core sample segment, the core break surface 140 extend can into the 3D projection 143 of the inner operative circumference along the transverse axis 103 by about 0.05 inches. In exemplary aspects, for a 0.5 inch diameter inner operative circumference, and a 0.75 inch long core sample segment, the core break surface 140 can extend into the 3D projection 143 along the transverse axis 103 by about 0.04 inches.

In some aspects, the drill bit 100 can be configured to couple to a drill rod 22 having a given diameter. For example, in some conventional drilling applications, for a drill rod of a given size, the inner diameter of said drill rod can be standardized. In some optional aspects, the core break surface 140 can be spaced from the cutting face 112 by a predetermined distance that is selected to form core segments 204 of a desired length. That is, the drill bit 100 can define a break length lb (FIG. 4) along the central axis 102 from the cutting face to a location at which the core break surface 140 extends into the imaginary 3D projection 143. It is contemplated that the break length lb can form core samples having respective segment lengths ls that are approximately (e.g., within 25%, 15%, within 10%, within 5%, or within 1%, plus or minus, of) the break length lb. Each core sample can further have a major dimension dm (i.e., a maximum end-to-end dimension) that is a generally a function of the core segment diameter and the segment length ls. It is contemplated that the crown can be configured to wear with use. It should, therefore, be understood that break length lb can change over time.

It is contemplated that the strength of the formation, which can determine or correspond to a level of difficulty of breaking a core sample, can guide selection/determination of the inner operative circumference as well as break length lb. That is, the larger the sample diameter, the more difficult the core sample is to break. In order to break larger samples with larger diameters, a longer core sample length can be used to generate more stress, thereby permitting breakage of said larger samples. However, as described herein, longer core samples that cannot tumble within the drill string during return can lead to jamming. Still further, it can be advantageous for samples to have sufficient dimensions that they (a) cannot pass each other within the drill string; and (b) are not so small that they fall out of the return flow (e.g., near the inner surfaces of the drill string, where flow velocity is lowest). Accordingly, sample diameter can be optimized based on ability to break and return samples to the proximal end of the drill string. For example, core samples can be about twice as long as their diameter. In these aspects, it is contemplated that the break length lb can be selected to form core samples formed having a length ls that is less than the inner diameter of the drill string. Thus, for example, for a drill string having an inner diameter of about 1-13/16 inches (about 1.8 inches), the inner operative circumference can have a diameter of ¾ inch and a core break surface that forms core segments having lengths of about 1.5 inches. In further aspects, it is contemplated that the break length lb can be selected to form core samples formed having a major dimension dm that is less than the inner diameter of the drill string. In various aspects, the core break surface can be positioned to form core segments having a length that is less than 95% of, or less than 90% of, from about 50% to about 100% of, or from about 60% to about 95% of, or from about 75% to 90% of, the inner diameter of the drill string. Still further, the core break surface can be positioned to form core break segments having a length that is from about 50% to about 300% of, from about 100% to about 250% of, or from 125% to 225% of, or about 200% of the diameter of the inner operative circumference. Thus, in exemplary, optional aspects, the break length lb can be from about 50% to about 300% of, from about 100% to about 250% of, or from 125% to 225% of, or about 200% of the diameter of the inner operative circumference. For example, in some optional aspects, the break length lb can be from about 10 mm to about 100 mm, or from about 20 mm to about 50 mm. It can be advantageous for the core segments to have a length that is sufficiently small relative to the inner diameter of the drill rod to allow the core segments to tumble over their axial ends to inhibit jamming, particularly when subject to centrifugal rotation during drilling.

In some aspects, the drill bit 100 can comprise a breaking element 142 that defines the core break surface 140. In some aspects, breaking element 142 can comprise hardened stainless steel or tungsten carbide. Advantageously, spherical elements are commercially available and often used for roller bearings. Accordingly, in some aspects, the breaking element 142 can comprise a spherical breaking element. In some aspects, the breaking element 142 can be held in a fixed, non-rotatable position. In further aspects, the core break surface 140 can be defined by rolling element (e.g., a spherical ball bearing, a cylindrical roller, or any other suitable shape) that is configured to rotate.

In some optional aspects, the breaking element 142 can be configured to move about the central axis 102 relative to the drill bit 100 as the drill bit rotates. In this way, as the drill bit and drill string rotate, the breaking element 142 can remain rotationally fixed (or rotate at a slower speed than the drill bit). In other aspects, the breaking element 142 can be fixed relative to the drill bit 100 and, therefore, rotate with the drill bit about the central axis 102.

In some optional aspects, the drill bit 100 can comprise a sleeve 150 that is received within the inner bore 106 of the shank 104. The sleeve 150 can define a receptacle 152 that receives at least a portion of the spherical element 142. In some aspects, the receptacle 152 can permit rotation of the spherical element 142 therein. In further aspects, the receptacle 152 can hold the spherical element 142 in a fixed, non-rotatable position. A drill string component 18 can threadedly couple to the shank 104 of the crown so that a distal end of the drill string component biases against the sleeve 150 to retain the sleeve within the inner bore 106 of the shank 104. In some aspects, the shank 104 of the drill bit 100 can define a shoulder 151 that the sleeve 150 abuts. In some aspects, the sleeve 150 can define one or more (two shown) longitudinal channels 154 that extend along the central axis 102. The longitudinal channels 154 can be positioned to weight-balance the sleeve about the central axis 102. Further, the longitudinal channel(s) 154 can be configured to communicate fluid past the sleeve 150.

It is contemplated that the ideal distance that the core break surface 140 extends into the imaginary 3D projection 143 can depend on the formation. For example, in some situations, a softer formation can require a greater distance that the core break surface 140 extends into the imaginary 3D projection 143 in order to break (and not shave) the core sample, as compared to a relatively harder formation. Accordingly, in some aspects, the distance that the core break surface 140 extends into the 3D projection 143 along the transverse axis can be adjustable. For example, in some aspects, a spacer (e.g., a washer) can be positioned between the shank and the breaking element 142 to space the core break surface into the 3D projection 143.

Referring to FIGS. 16-21, in some aspects, sleeve 150 can comprise an inner body and an outer body, wherein the rotational position of the inner body 160 relative to the outer body 162 determines the distance that the core break surface 140 extends into the 3D projection 143 along the transverse axis. Accordingly, an operator can select the distance that the core break surface 140 extends into the imaginary 3D projection 143 by selecting the rotational position of the inner body relative to the outer body. In use, it is contemplated that the adjustment of the distance that the core break surface 140 extends into the 3D projection 143 along the transverse axis can allow the operator to mitigate changes in formation strength.

Referring to FIGS. 16-19, in some aspects, the inner body can be rotatable within the outer body. For example, both the inner body 160 and the outer body 12 can be annuluses. The outer body 162 can have a cylindrical inner surface 164, and the inner body can have a cylindrical outer surface 166 that is receivable within a space defined by the cylindrical inner surface 164. The inner body 160 can define the receptacle 152 that receives at least a portion of the spherical element 142. The cylindrical inner surface 164 of the outer body can be eccentric relative to an outer surface 168 of the outer body. That is, the outer surface 168 of the outer body can surround a first central axis 170, and the cylindrical inner surface 164 of the outer body 162 can surround a second central axis 172 that is radially offset from the first central axis 170. Accordingly, as can be seen between FIGS. 18-19, the rotational orientation of the inner body relative to the outer body 166 can determine the distance that the core break surface 140 extends into the imaginary 3D projection 143. A fastener 178 can secure the rotational position of the outer body 102 relative to the inner body 160. For example, the outer body can define a plurality of openings 174, and the inner body can define one or a plurality of openings 176 that, when aligned with a respective opening of the plurality of openings, can simultaneously receive the fastener 178 (e.g., a press-fit pin), thereby inhibiting rotational movement between the outer an inner bodies 162, 160.

Figure 21:
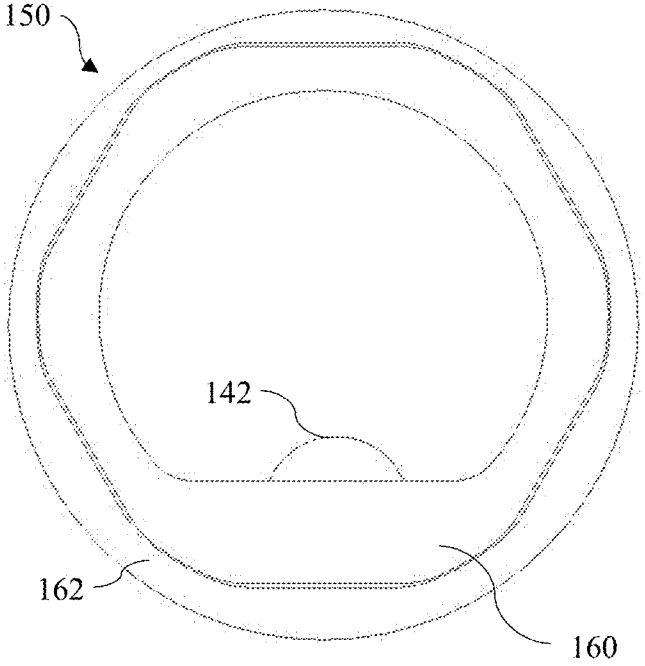
FIG. 21 is a perspective view of the sleeve of FIG. 20.
Figure 20:
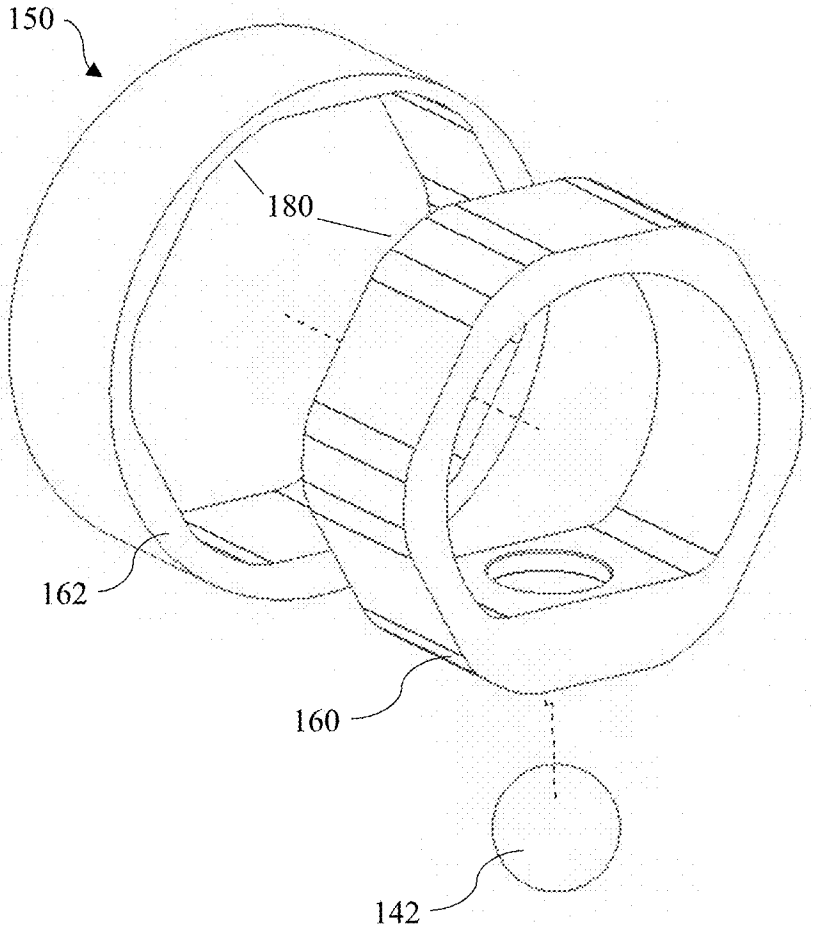
FIG. 20 is an exploded view of an exemplary sleeve for retaining a breaking element of a drilling assembly as disclosed herein.

Referring to FIGS. 20-21, in some aspects, the inner body 160 and outer body 162 can define complementary surfaces that permit receipt of the inner body with the outer body in a plurality of discrete, predetermined orientations, while inhibiting rotation of the inner body relative to the outer body from the predetermined orientations. For example, in some aspects, the inner body 160 and outer body 162 can define flats 180 that, when aligned, permit receipt of the inner body within the outer body but inhibit rotation of the inner body relative to the outer body from the predetermined orientations. The rotational position of the inner body 160 relative to the outer body 162 can determine the distance that the core break surface 140 extends into the imaginary 3D projection 143. Because the inner body 160 is inhibited from rotating relative to the outer body 162 by the complementary surfaces, in some aspects, the outer body and inner body do not need a fastener. Rather, as illustrated in FIG. 4, the inner and outer bodies 160, 162 of the sleeve 150 can be axially retained between the drill rod 18 and the crown of the drill bit.

The crown 110 can further comprise one or more radial slots that are configured to communicate fluid from the outer circumference of the drill bit 100 to the core receiving slot 116. In this way, core segments 204 and cuttings can be flushed through the shank and through the drill string. The cuttings can be understood to be the portions of the formation that are formed by engagement between the cutting face 112 of the crown 110 and the formation, as are formed during conventional drilling.

For example, the radial slot(s) can be embodied as respective face channels 130. Each face channel 130 can extend between and be in communication with the core-receiving slot 116 and the outer operative circumference 114 of the crown 110. In some aspects, the crown 110 can comprise only one single face channel 130. In further aspects, the crown can define a plurality of (e.g., two, three, four, five, or more) face channels 130. Optionally, in addition to the face channels 130, it is contemplated that the radial slots can further comprise at least one slot that is spaced proximally from the cutting face and fully enclosed by the structure of the crown, with the at least one slot extending between the inner and outer operative diameters of the crown.

In some aspects, the crown 110 can comprise a plurality of crown portions 152 that project from the shank and that at least partially define the core receiving slot 116. For example, the crown portions 152 can be circumferentially spaced around the crown, with respective face channels 130 defined between the crown portions 152. Optionally, the crown 110 can comprise two crown portions. In further aspects, the crown can comprise three, four, five (as shown), six, or more crown portions 152.

Optionally, the outer surface of the crown 110 can define at least one axial channel 132 that is radially inwardly recessed from the outer operative circumference 114 of the crown. In some aspects, the face channels 130 can be aligned with respective axial channels 132 that are spaced inwardly from the outer operative circumference to permit fluid flow from the outer surface of the shank to the respective face channels 130.

In some optional aspects, the crown 110 can be impregnated with diamonds (e.g., natural or synthetic diamonds or diamond particles), thereby allowing the crown to be used to cut hard formations and/or to increase the durability of the bit. The part of the bit that performs the cutting action, sometimes referred to as a face, can be generally formed of a matrix that contains a powdered metal or a hard particulate material, such as tungsten carbide. This material can be infiltrated with a binder, such as a copper-based alloy. The matrix and binder associated with the face can be mixed (impregnated) with diamond crystals (synthetic or natural) or another form of abrasive cutting media using conventional methods. As the drill bit grinds and cuts through the formation, the matrix and binder can erode and expose new layers of the diamond crystal (or other cutting media) so that sufficient cutting action is maintained during use of the drill bits disclosed herein.

In exemplary aspects, the crown 110 can optionally comprise a plurality of projections 115 extending distally from the cutting face 112. Optionally, the projections 115 can be integrally formed with the crown 110. Accordingly, the projections 115 can comprise the same matrix as the crown 110. In further embodiments, the projections 115 can comprise matrices that are different from their respective crowns. U.S. Pat. No. 9,637,980, issued to Longyear™ Inc. on Aug. 15, 2017, which is hereby incorporated herein by reference in its entirety, discloses further aspects of diamond impregnated bits and associated projections that can optionally be implemented with the drill bit 100. Optionally, in some aspects, the projections 115 can be distributed among a plurality of arcuate rows, with each arcuate row containing projections having a center point that is located at a given radius from the central axis. Optionally, in these aspects, it is contemplated that the projections within at least one arcuate row can radially overlap or be radially staggered with the projections of at least one other arcuate row. In further aspects, it is contemplated that the plurality of projections 115 can be evenly or substantially evenly distributed throughout the cutting face 112. In other aspects, it is contemplated that the plurality of projections 115 can have an uneven distribution, with selected areas of the cutting face 112 having a greater concentration of projections than other areas of the cutting face.

Drilling Assembly with Drill Bit Having Core Break Structure

Referring to FIG. 4, a drilling assembly 300 can comprise one or more tubular members 18 (e.g., one or more drill rods) that are coupled to the drill bit 100. For example, the drill bit 100 can be threadedly coupled to the tubular members 18. A distal tubular member that is coupled to the drill bit can bias against the sleeve 150 to axially retain the sleeve.

Drilling Assembly with Drill String Component Having Core Break Structure

Figure 5:
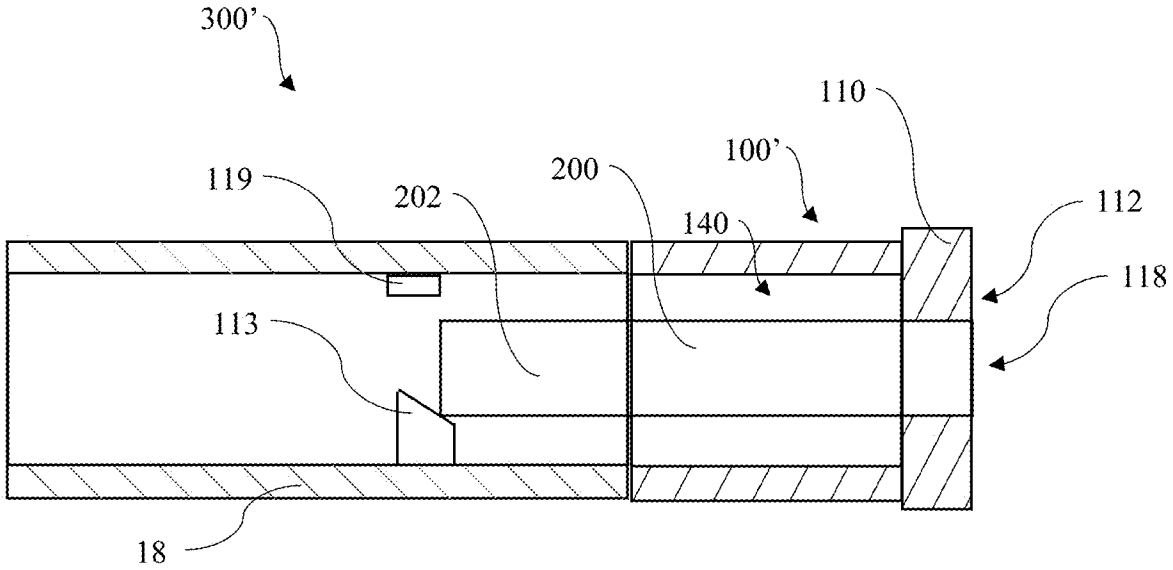
FIG. 5 is a schematic diagram of a drilling assembly in accordance with the present disclosure.

Referring to FIG. 5, in further aspects, it is contemplated that the core break structure can be independent of the drill bit. For example, the core break structure can be defined by a drill string component that is positioned proximally of, and coupled to, the drill bit. In some aspects, a drilling assembly 300' can comprise a drill bit 100' that is coupled to one or more drill string components 18. The drill bit 100' can define an inner operative circumference 118 that can leave a portion 202 of a formation 200 intact with the rest of the formation. The drill string component 18 (or any drill string component that is proximal of the drill bit) can comprise the core break structure 113. The portion 202 of the formation 200 can extend inwardly into the core receiving slot 116 until the portion 202 engages the core break structure 113. Optionally, a mass 119 can rotationally counterbalance the core break structure 113.

Dual Tube Drill String Embodiment

Referring to FIGS. 6A-8B, in further aspects, a drill bit 400 can be configured for use with a dual tube drill string (e.g., comprising one or more drill rods having an inner tube and an outer tube that define an annulus therebetween). As described herein, this can be advantageous for situations in which ground conditions do not support fluid flow between the formation and an outer surface of the drill string.

Referring to FIGS. 6A-6D, the drill bit 400 can have a central axis 102. The drill bit 400 can comprise a shank 104 defining an inner bore 106. The shank 104 can define at least one thread 108 (e.g., one or more female threads) that are configured to couple to an outer tube 302 of a dual tube drill rod 301.

The drill bit 400 can further comprise a crown 110, which can have a cutting face 112 that defines an outer operative circumference 114.

The crown 110 can comprise a core receiving slot 116 in communication with the inner bore 106 of the shank 104. The core receiving slot 116 can extend inwardly into the crown from the cutting face. The crown 110 can define an inner operative circumference 118. That is, as the drill bit 400 rotates, the cutting face 112 of the drill bit can define an inner area within which the cutting face 112 does not engage the formation as the drill bit advances. Accordingly, as the drill bit 400 advances into a formation 200, a portion 202 of the formation within the inner operative circumference 118 can remain intact with the rest of the formation and extend inwardly into the core receiving slot 116.

In some optional aspects, the drill bit 400 can comprise a core break structure 113 disposed within the shank 104. In further optional aspects, the core break structure 113 can be positioned within the drill string that is coupled to the drill bit 400. Optionally, the core break structure 113 can be integrally formed with the rest of the drill bit. In further aspects, the core break structure 113 can be defined by a component that is received within a recess 117 defined by the drill bit. For example, as illustrated in FIG. 11, and as further described herein, a sub 310 can be received within the drill bit 400 and bias against the core break structure 113 to act as a stop that inhibits proximal axial movement of the core break structure.

The core break structure 113 can define a core break surface 140 that extends radially inwardly toward the central axis 102 and intersects the imaginary 3D projection 143 of the inner operative circumference 118 projected along the central axis. In some aspects, the core break surface 140 extends across only a portion of the projection 143 of the inner operative circumference 118 projected through the drill bit 100 along the central axis 102. Thus, in some aspects, the core break surface 140 can extend into said 3D projection 143 of the inner operative circumference 118 (from outside of the 3D projection 143) transversely by less than the diameter of the inner operative circumference 118 (e.g., along a transverse axis 103 that is perpendicular to, or generally perpendicular to, the central axis 102). In some aspects, the central axis 102 does not extend through the core break surface 140.

In yet further aspects, the drill bit 400 can omit the core break surface, and a separate portion of the drill string (e.g., the sub 310 or the dual tube drill rod 301) can define the core break surface.

Figure 11:
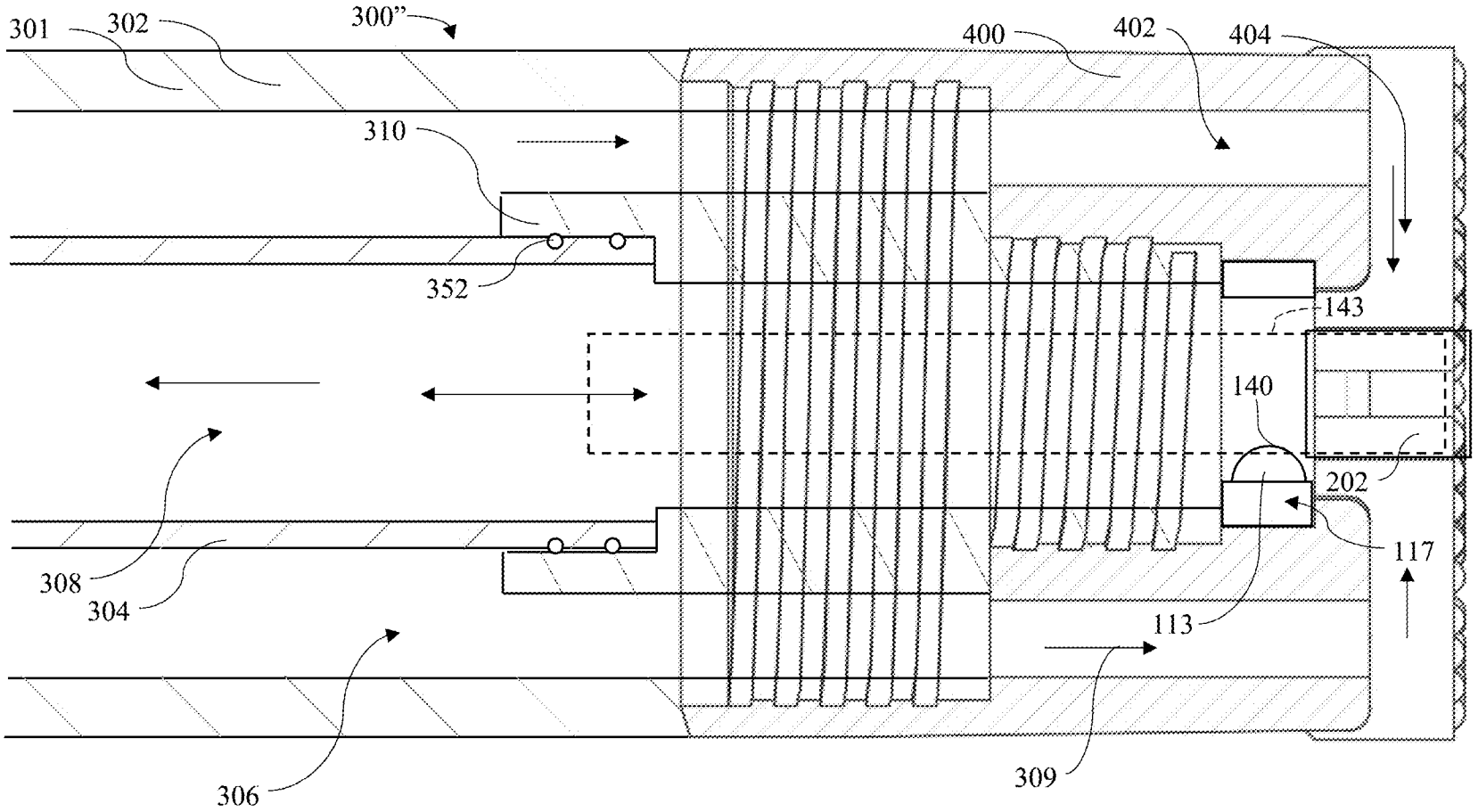
FIG. 11 is a cross sectional schematic diagram of a drill string comprising a drill bit as in FIG. 6A.
Figure 12:
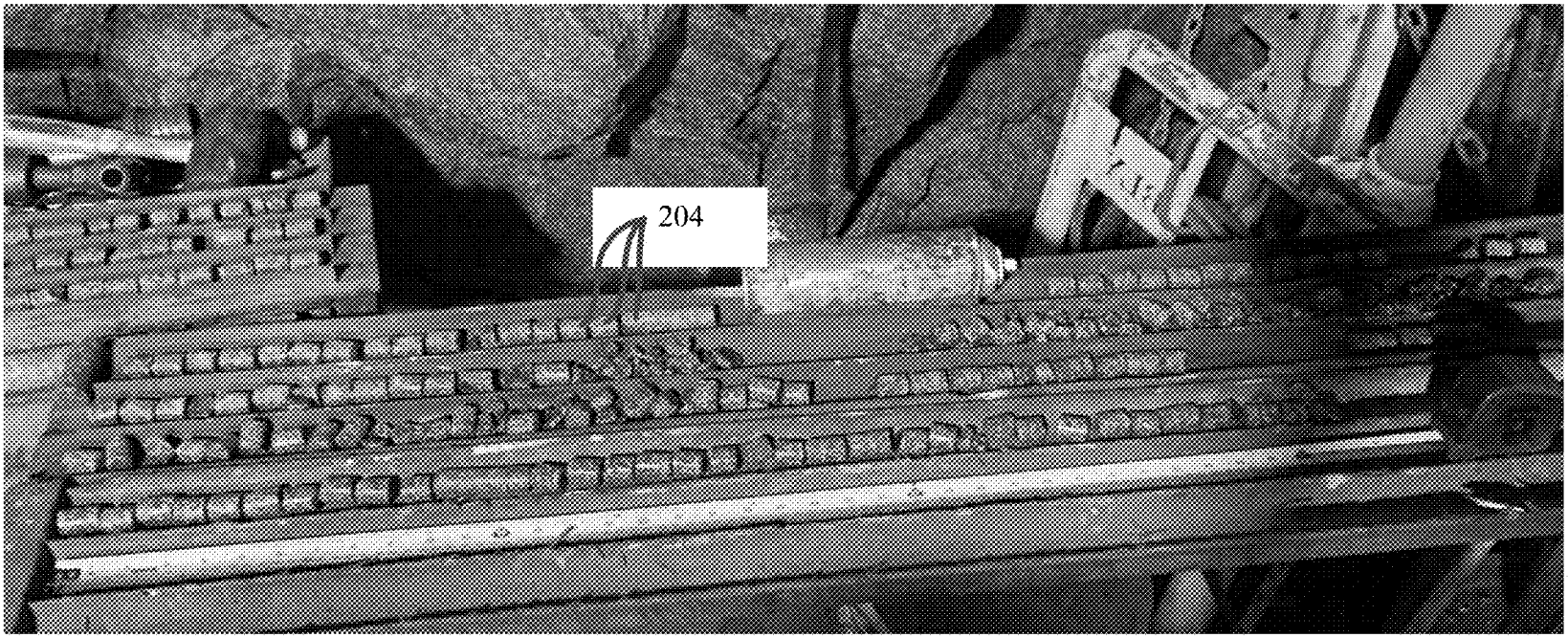
FIG. 12 is a perspective view of a plurality of core segments arranged end-to-end to provide a continuous core sample.

Referring to FIG. 11, a drilling assembly 300" can comprise an outer tube 302 and an inner tube 304 received within the inner tube. The inner tube 304 and outer tube 302 can cooperate to define an annular space 306. The inner tube 304 can define an inner pathway 308. A drill bit (e.g., the drill bit 400) can be coupled to the outer tube 302. For example, the shank 104 can be threadedly coupled to the outer tube 302.

Figure 9A:
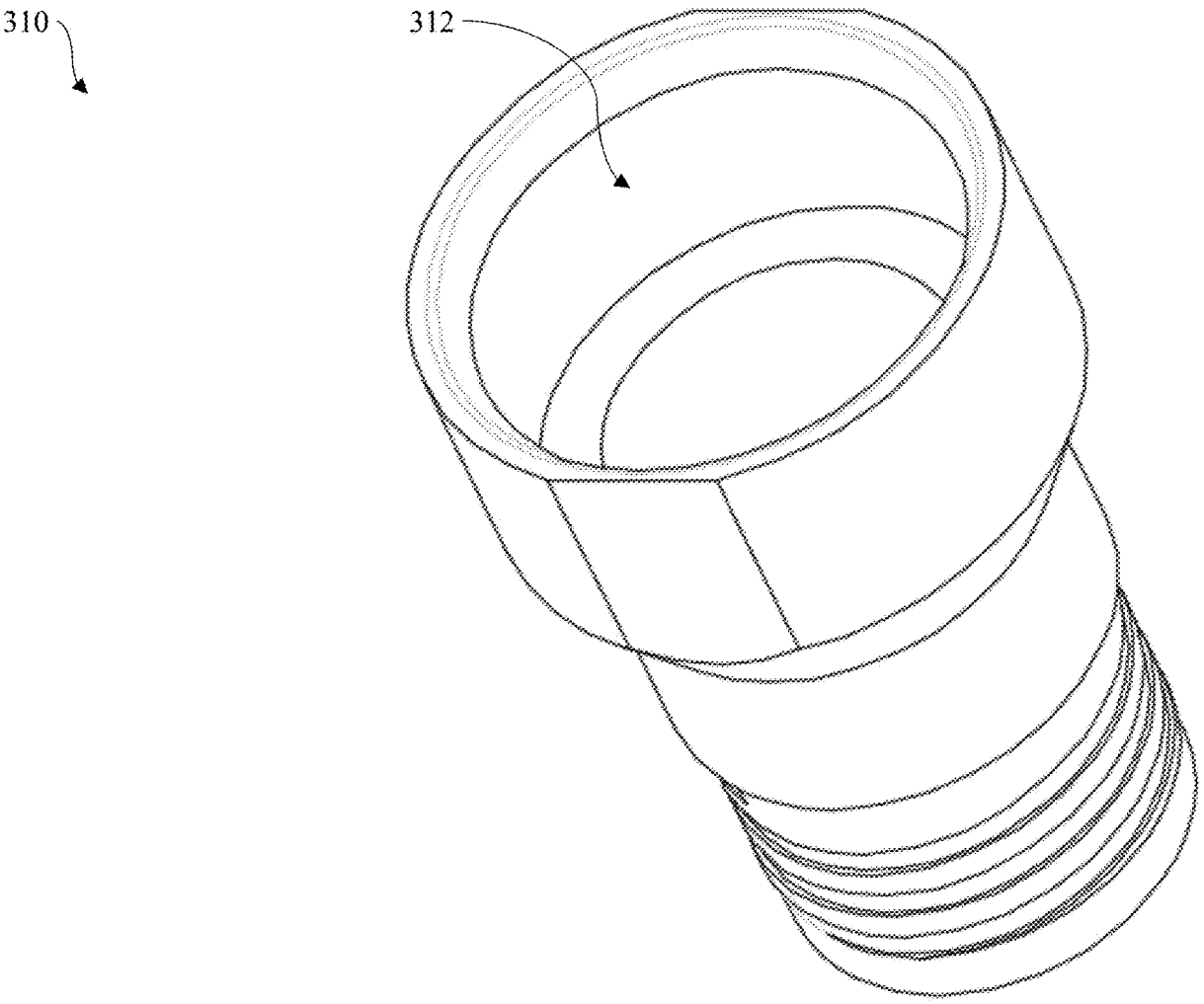
FIG. 9A is a perspective view of an exemplary sub for use with the drill bits as in any one of FIGS. 6A-8B.
Figure 9B:
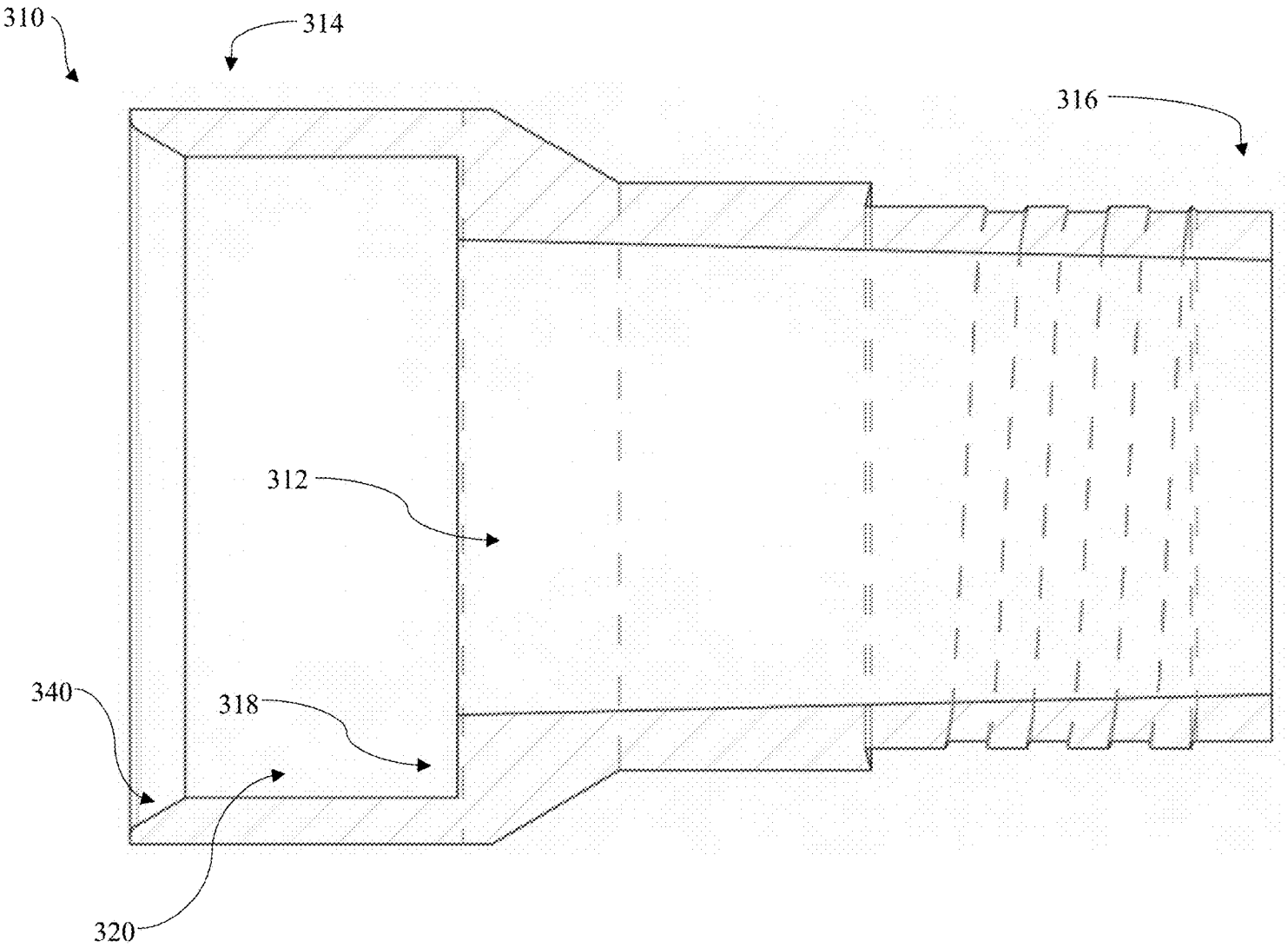
FIG. 9B is a cross sectional view of the sub of FIG. 9A.
Figure 10:
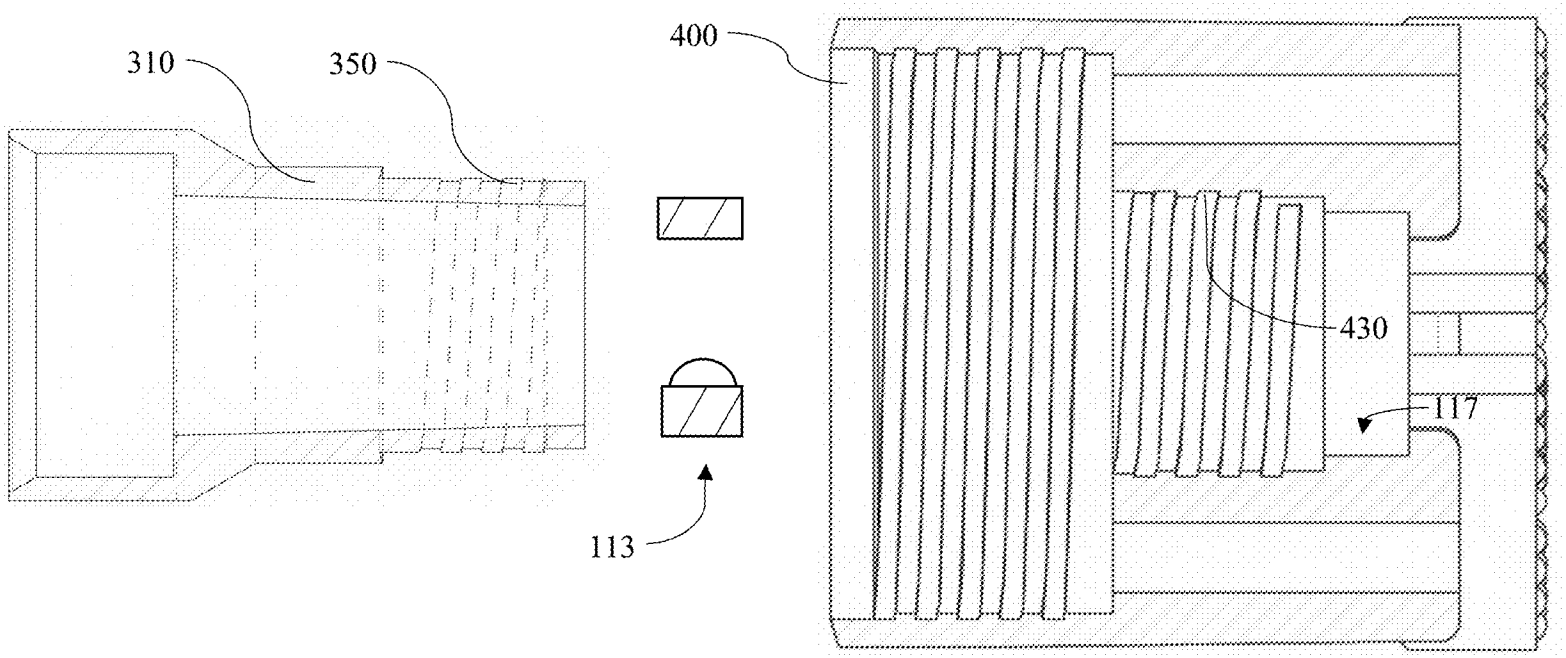
FIG. 10 is an exploded view of a drill bit of FIG. 6A and the exemplary sub of FIG. 9A.

Referring also to FIGS. 9A, 9B, and 10, in some aspects, the drilling assembly 300 can further comprise a sub 310. The sub 310 can be configured to provide fluid communication between the core receiving slot and the inner tube 304. For example, the sub 310 can define a central bore 312 that extends between, and provides fluid communication between, the core receiving slot 116 of the crown 110 of the drill bit 100 and the inner tube 304. The drill bit 400 can define at least one thread 430 (e.g., a female thread within the shank 104) that couples to at least one thread 350 of the sub 310.

The sub 310 can have a proximal end 314 and a distal end 316. The central bore 312 can optionally be tapered distally. In further aspects, the central bore 312 can be tapered proximally. In this way, the central bore 312 nearest the proximal end 314 of the sub 310 can have the same, or substantially the same diameter as the inner diameter of the inner tube 304. For example, the spacing between outermost sides 145 of the conduits 144 can define a maximum flow width through the bit. It is contemplated that the inner diameter of the central bore 312 at the distal end 316 can be substantially equal to, or equal to, the maximum flow width.

The sub 310 can define a shoulder 318. A receiving space 320 can extend from the proximal end 314 of the sub to the shoulder 318. The receiving space 320 can be configured to receive a distal end of the inner tube 304 so that the inner tube engages the shoulder 318. In some aspects, the proximal end of the sub can define a tapered surface 340 to guide the inner tube into the cylindrical receiving space. Optionally, the sub 310 can define one or more O-ring grooves that receive respective O-rings 352 for providing a seal between the sub and the inner tube. In further aspects, the O-rings can be received within grooves of the inner tube 304.

The proximal end 314 of the sub 310 can engage a portion of the drill bit to direct all, or substantially all flow from the core receiving slot 116 through the central bore 312 of the sub 310. For example, the drill bit 100 can define an inner cylindrical surface 320 that receives a portion of the proximal sub 310. The sub 310 can define a reduced diameter portion 322 that is receivable into the inner cylindrical surface 320. In this way, the central bore 312 at the proximal end 314 of the sub 310 can have the same, or substantially the same diameter as the inner diameter of the inner tube 304, thereby preventing a lip between the sub and the conduits 144.

Accordingly, the sub 310 can define a portion of a flow path 309 from the annular space 306 to the crown 110 and from the core receiving slot 116 to the inner pathway 308.

Figure 6B:
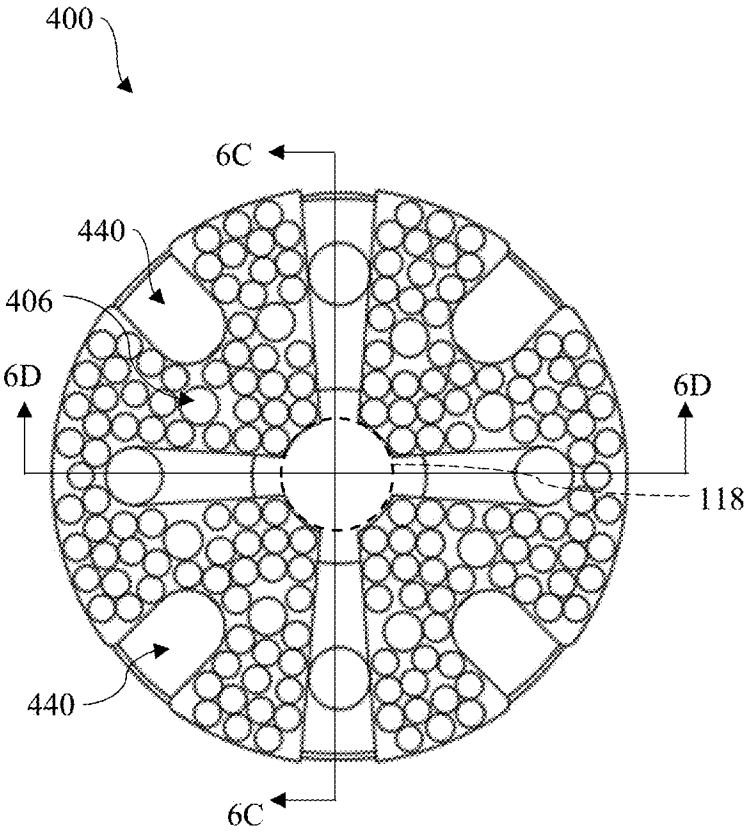
FIG. 6B is a distal end view of the drill bit of FIG. 6A.
Figure 6A:
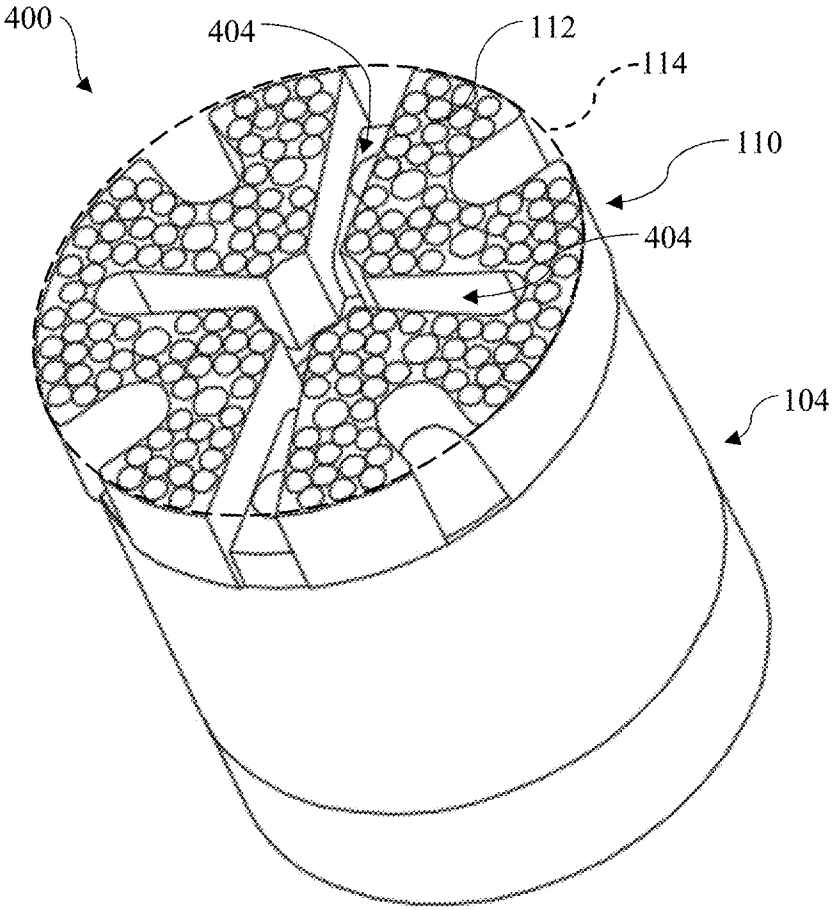
FIG. 6A is a perspective view of a drill bit for use with a dual tube drill string.
Figure 6C:
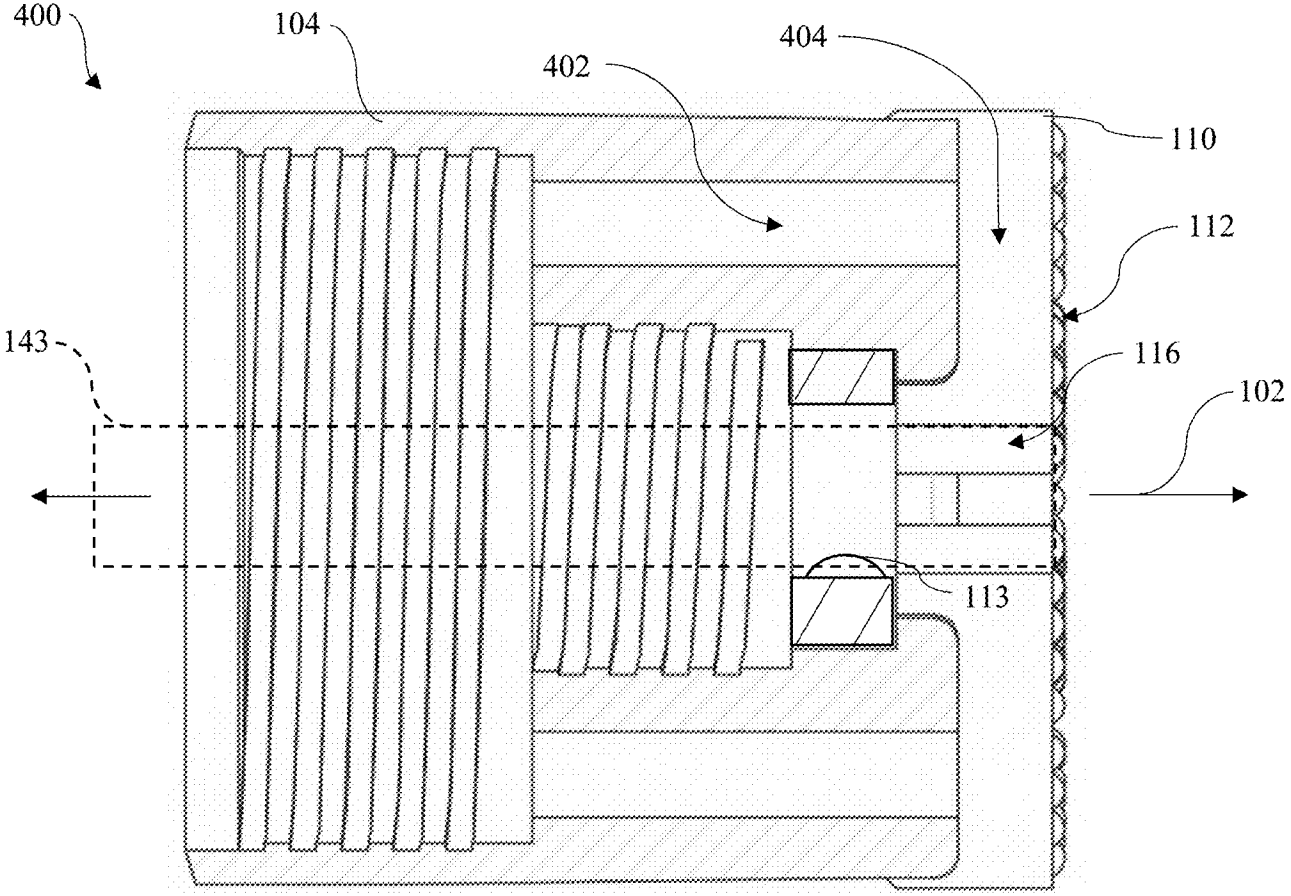
FIG. 6C is a cross sectional view of drill bit of FIG. 6A along the plane 6C-6C in FIG. 6B.
Figure 6D:
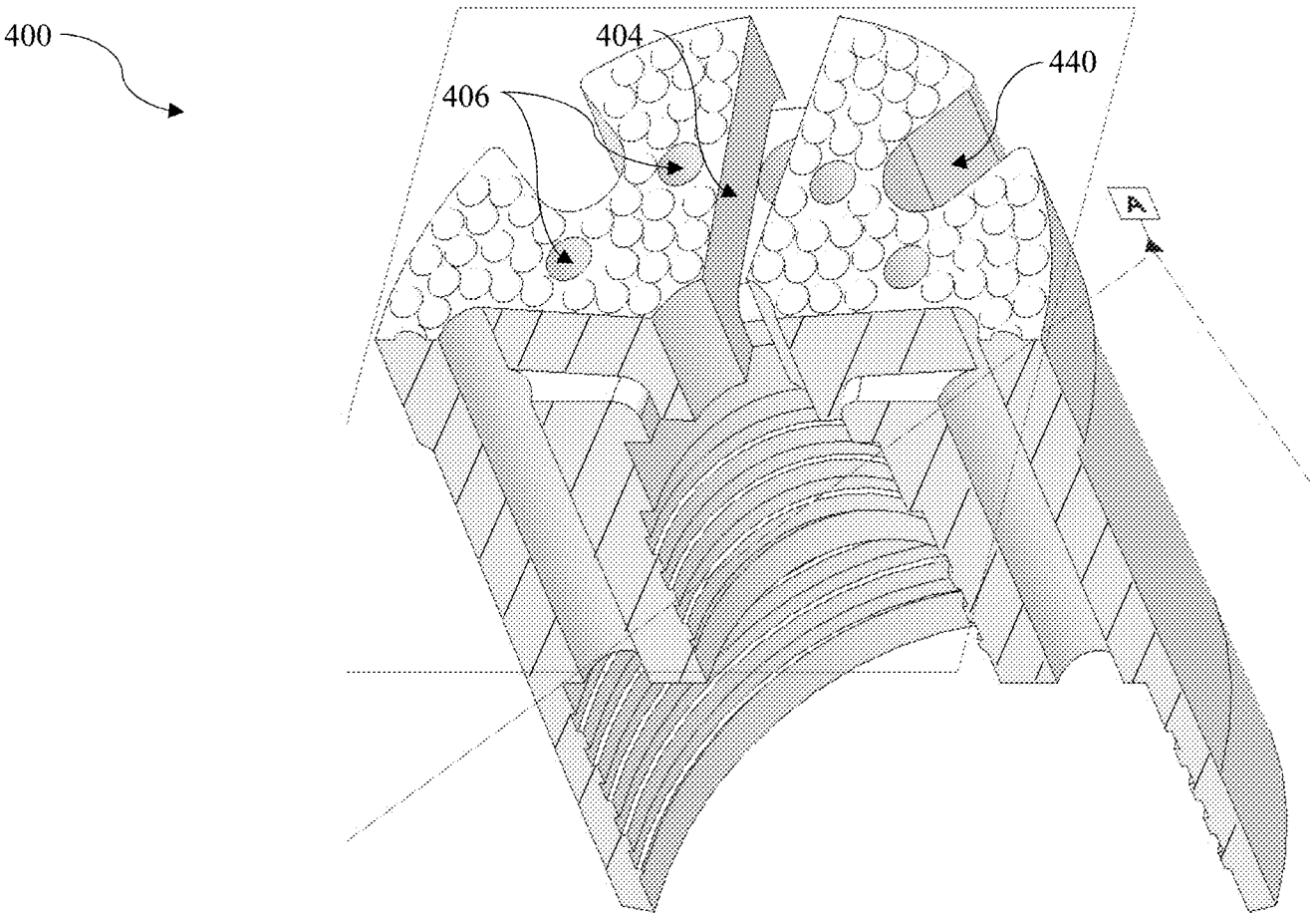
FIG. 6D is a sectional view of the drill bit of FIG. 6A along the plane 6D-6D.

Referring to FIGS. 6A-6C, in some aspects, the drill bit 400 can define at least one axial conduit 402 (e.g., 1, 2, 3, 4 or more axial conduits) that extends axially along the central axis of 102 the drill bit to provide fluid communication from the annular space 306 to the crown. Accordingly, the axial conduits 402 can be spaced radially from the central axis 102 to be positioned at the radial location of the annular space 306.

In some aspects, the crown 110 can define one or more face channels 404 that extends from a respective axial conduit 402 to the core receiving slot 116. In this way, fluid can be communicated with a sufficient velocity to flush core segments from the borehole. Accordingly, the face channels 404 can have sufficient cross sectional area, in planes perpendicular to their radial length, to provide sufficient flow. Optionally, a respective face channel 404 can extend from each of the axial conduits 402 to the core receiving slot 116. In further aspects, one or more axial conduits 402 do not intersect a face channel that extends to the core receiving slot.

Figure 7B:
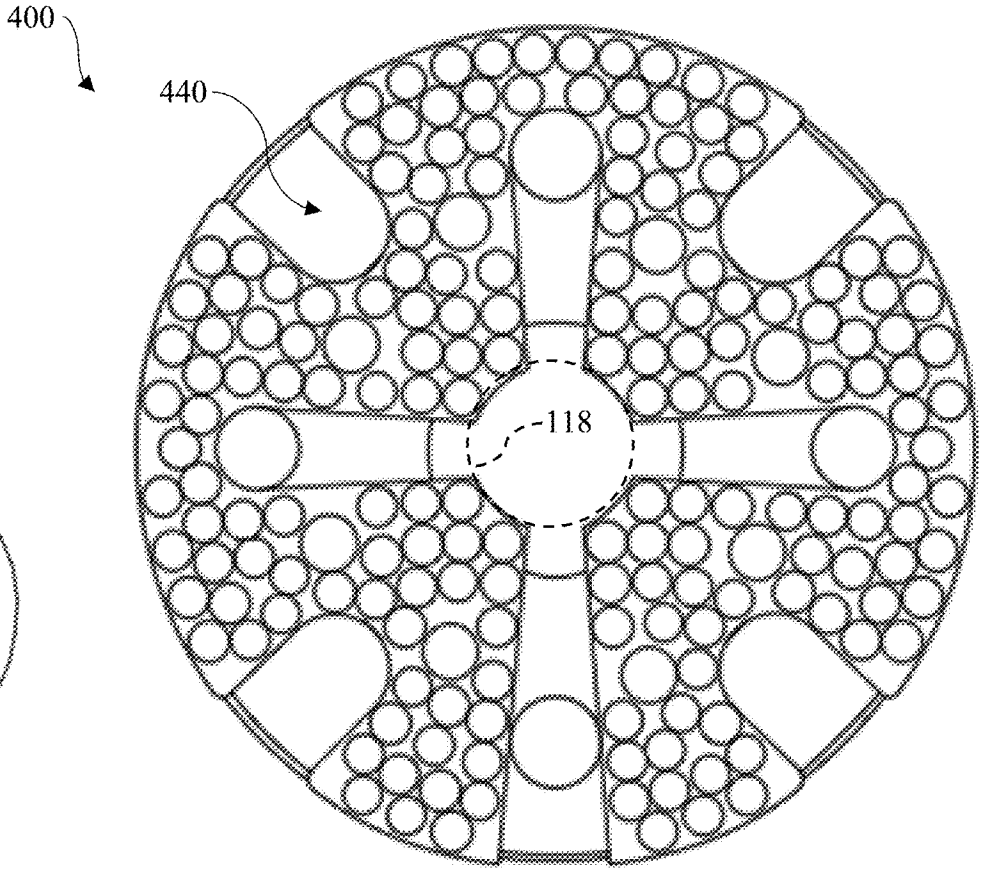
FIG. 7B is a distal end view of the drill bit of FIG. 7A.
Figure 7A:
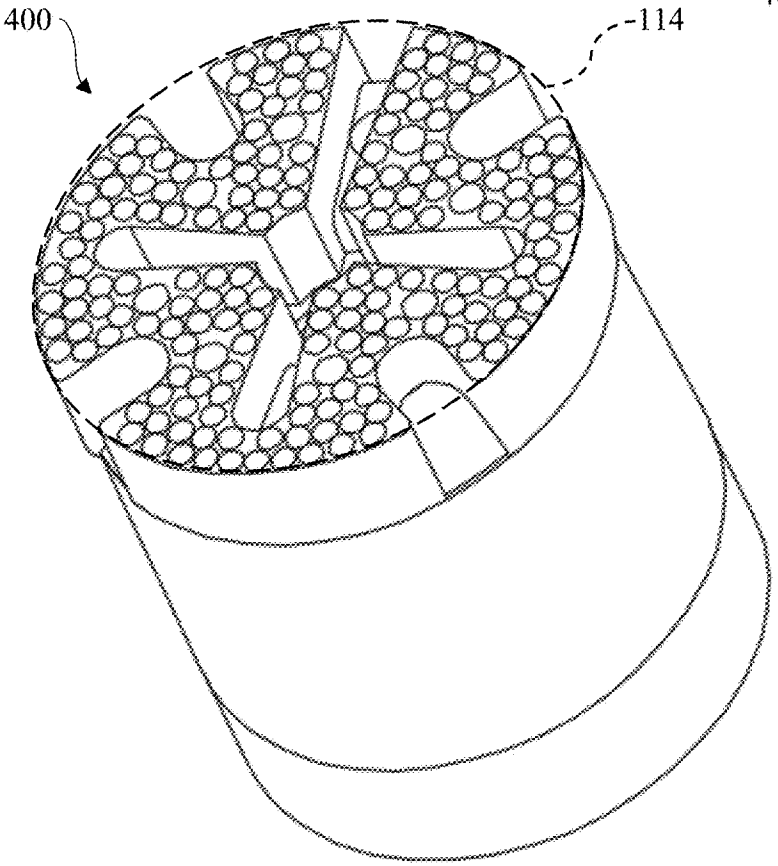
FIG. 7A is a perspective view of another drill bit for use with a dual tube drill string, wherein the drill bit has a single face channel that extends to the outer circumference of the crown.
Figure 8B:
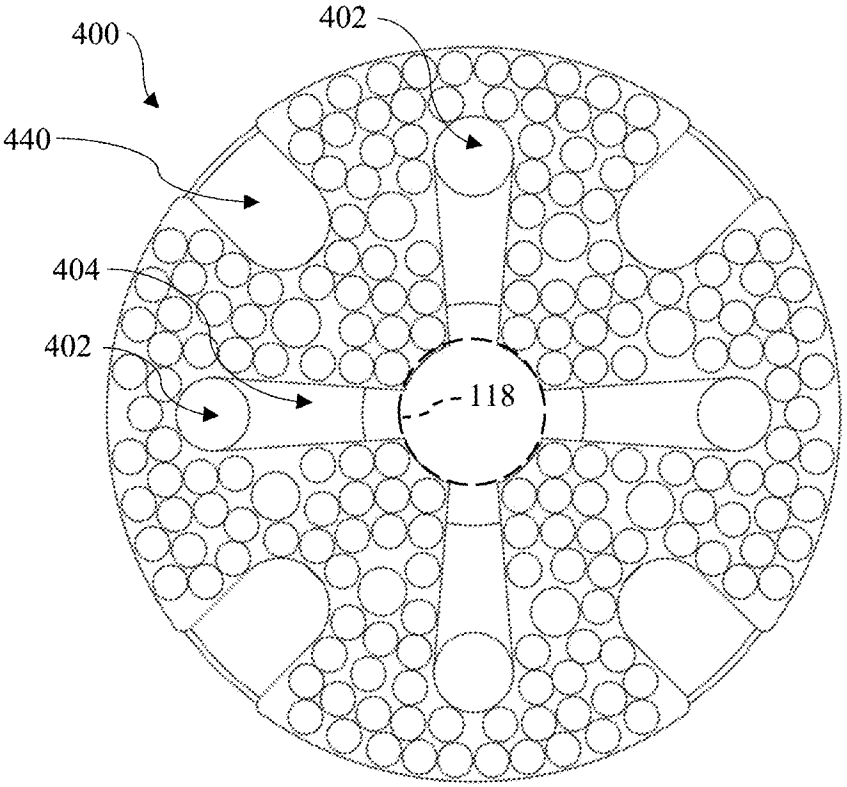
FIG. 8B is a distal end view of the drill bit of FIG. 8A.
Figure 8A:
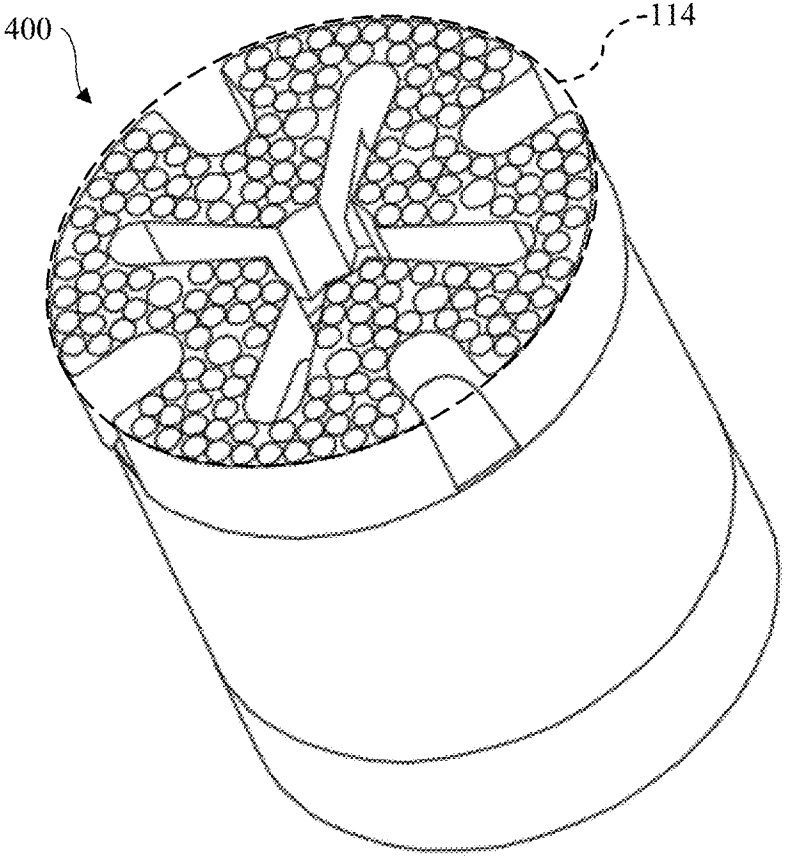
FIG. 8A is a perspective view of another drill bit for use with a dual tube drill string, wherein the drill bit does not have a face channel that extends to the outer circumference of the crown.

In some aspects, one or more of the face channels 404 (e.g., two, as shown in FIG. 6A, or one, as shown in FIG. 7A) can extend radially outwardly to the outer circumference of the drill bit. In this way, fluid can be communicated to the outer surface of the drill string. In further aspects, and as illustrated in FIG. 8B, none of the face channels 404 extend to the outer circumference of the drill bit.

Optionally, at least one of the axial conduits 402 can extend to the cutting face 112 (e.g., not intersecting a face channel) to define cutting face axial conduits 406 for lubricating and flushing the cutting face 112. For example, the drill bit 400 can comprise from 1 to ten axial conduits (e.g., about 4 or about 8). Optionally, said cutting face axial conduits 406 can have smaller cross sectional areas than the axial conduits 402 that intersect face channels.

The crown 110 of the drill bit 400 can further comprise one or more (e.g., 1, 2, 3, 4, or more) axial recesses 440 that are positioned at the outer circumference of the crown. The axial recesses 440 can create an open area to achieve improved penetration rates. Optionally, the axial recess 440 can extend through the entire crown 110 (that can define the outer operative circumference 114) to permit fluid flow from the cutting face 112 to the shank 104 (that has a smaller diameter than that of the outer operative circumference.

Exemplary Method of Use

Referring to FIGS. 4, 5, and 11, the drilling assembly 300 (or the drilling assembly 300' or the drilling assembly 300") can be advanced into a formation 200 to form drilling cuttings and core segments 204 as described herein. Fluid (e.g., water, drilling mud, or any suitable fluid) can be pumped through the annular space 306 between outer surface 304 of the drilling assembly 300 (or the drilling assembly 300' or the drilling assembly 300") and the formation 200. At least some of said fluid can travel through the face channels 130, 404 and return through the core receiving slot 116 and through the drill string. The fluid flow rate and pressure can be sufficient to overcome fluid drag from the surface to the bottom of the bore and back to the surface as well as to provide sufficient fluid flow to cool the drill bit. Further, a sufficient fluid velocity can be maintained to avoid settling of core sample pieces.

The core segments 204 returning through the drill string can be collected. For example, once pumped from the borehole, a conduit can deliver the mix of drilling fluid, cuttings, and core segments 204 to an apparatus (e.g., a screen or filter) that selectively filters out the larger segments pieces and allow the drilling fluid and cuttings to pass therethrough. Thus, the core sample pieces can be separated for analyzing the formation makeup. As the core segments are separated, the pieces can be associated with a depth at which they were separated from the formation. The core segments can be sufficiently large to enable geophysical interpretation of the drilled formation using conventional methods. In this way, the formation can be characterized. Optionally, the drilling cuttings can similarly be collected via the same or a different screen or filter.

An operator can know a beginning drilling depth, corresponding, generally, to a drill string length. As described herein, the core sample segments can be formed with sizes relative to the dimensions of the interior of the drill string so that core sample segments cannot pass each other as they travel proximally out of the hole. Thus, the samples can remain in the same order in which they are broken from the formation. Accordingly, as shown in FIG. 9, samples can, once returned to the surface, be arranged in order in which they are received and aligned end-to-end to provide a continuous core sample. Thus, a continuous core sample with a known starting depth can be formed.

Figure 14:
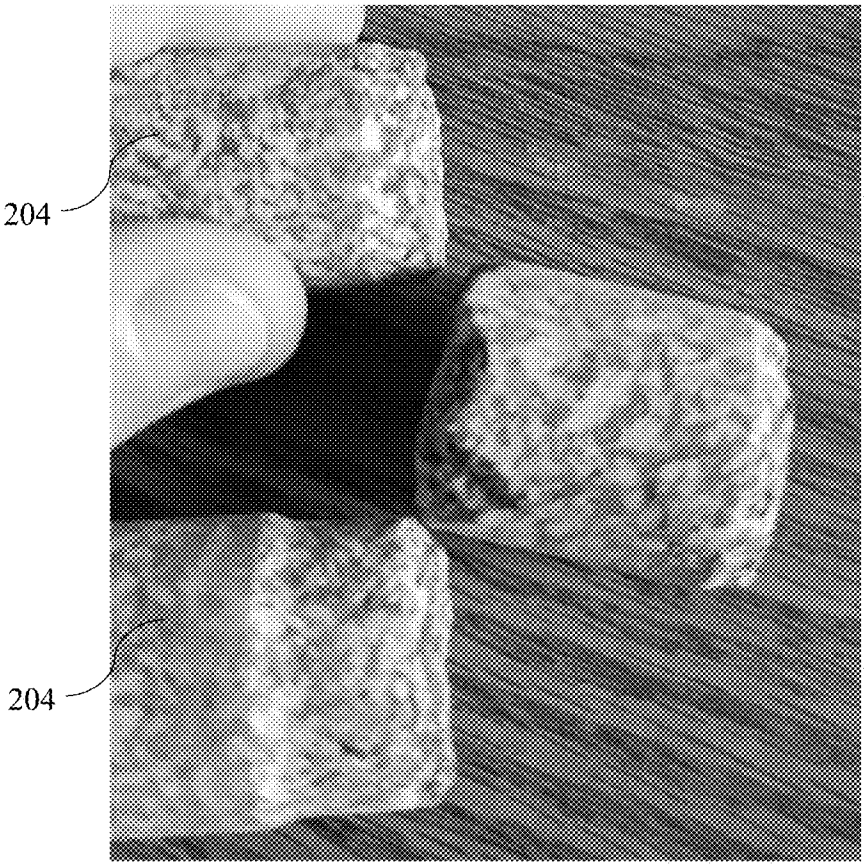
FIG. 14 is an image showing an example core segment having a circumferential groove formed thereon.
Figure 13:
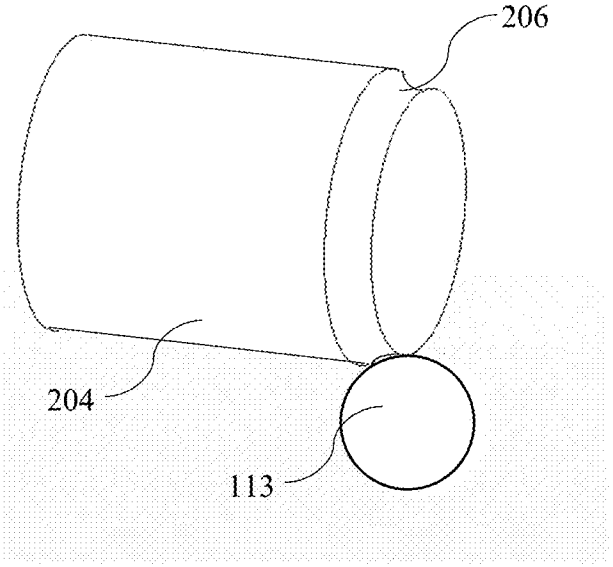
FIG. 13 is a perspective view of a core break structure forming a circumferential groove into a core segment.

Still further, referring to FIGS. 13 and 14, the core break structure 113 can form a reduced diameter (e.g., a circumferential groove 206) or other witness mark on the proximal end of each core segment 204 so that the orientation of the core segments can be identified, and the core segments can be axially oriented relative to each other with the proximal and distal ends positioned adjacent to respective distal and proximal ends of the two adjacent core segments.

The operator can further monitor for a reasonable amount of sample for a given amount of drill string feeding. Where there is a suspected loss of sample, feeding can be halted while rotation and flushing is maintained to attempt to recover stuck or lagging sample. Upon flushing the borehole, the operator can begin drilling again, thereby restarting the known depth from which core segments are being formed.

Figure 15:
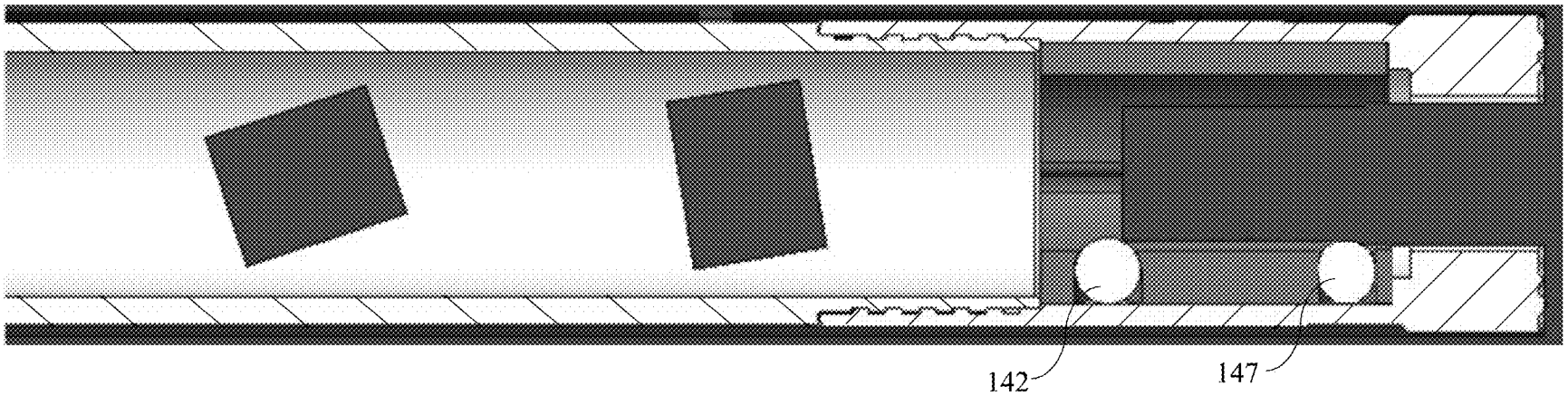
FIG. 15 is a cross-sectional view of an exemplary drill string assembly being advanced through a formation and forming core segments.
Figure 17:
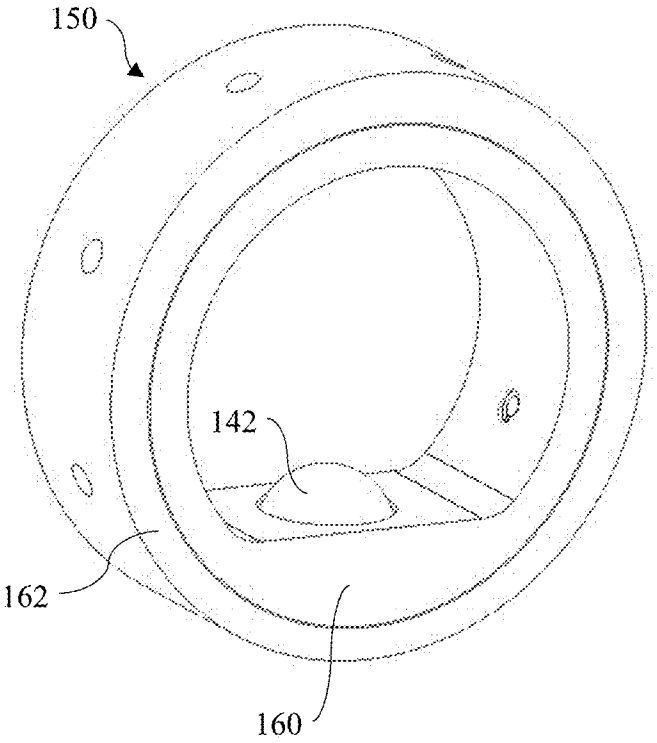
FIG. 17 is a perspective view of the sleeve of FIG. 16.
Figure 16:
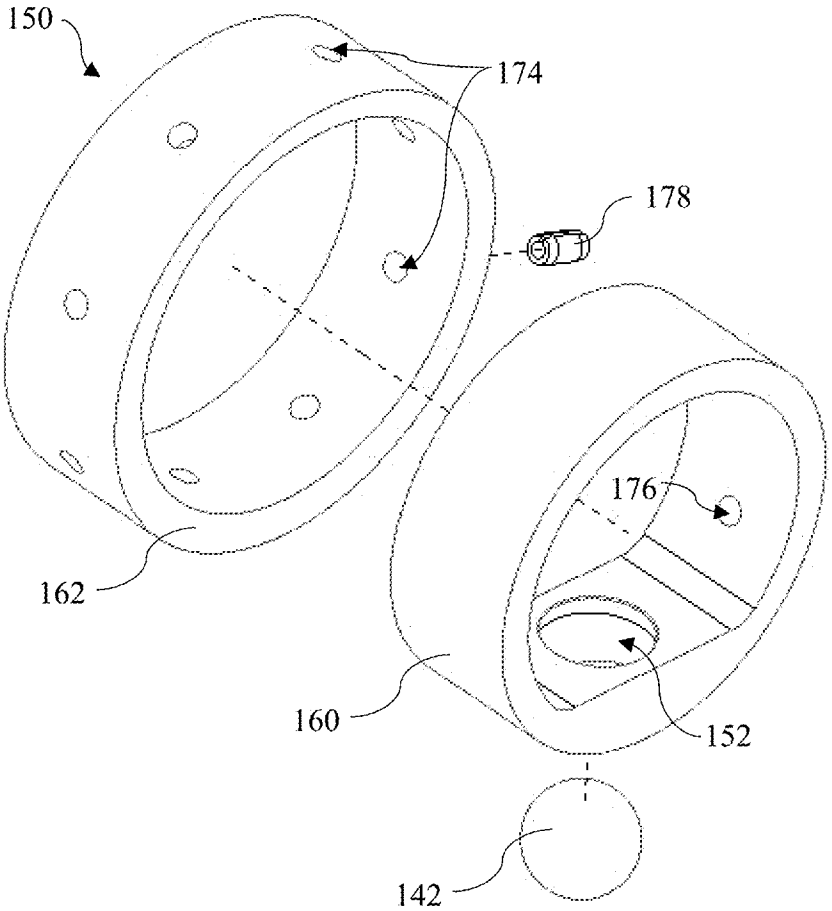
FIG. 16 is an exploded view of an exemplary sleeve for retaining a breaking element of a drilling assembly as disclosed herein.
Figure 19:
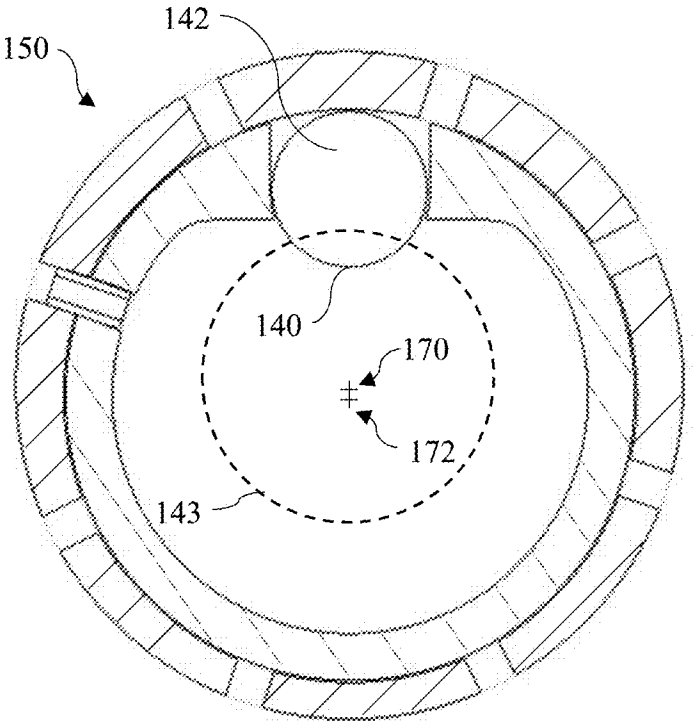
FIG. 19 is a cross sectional view of the sleeve of FIG. 16, with the inner body positioned relative to the outer body of the sleeve in a second rotational orientation.
Figure 18:
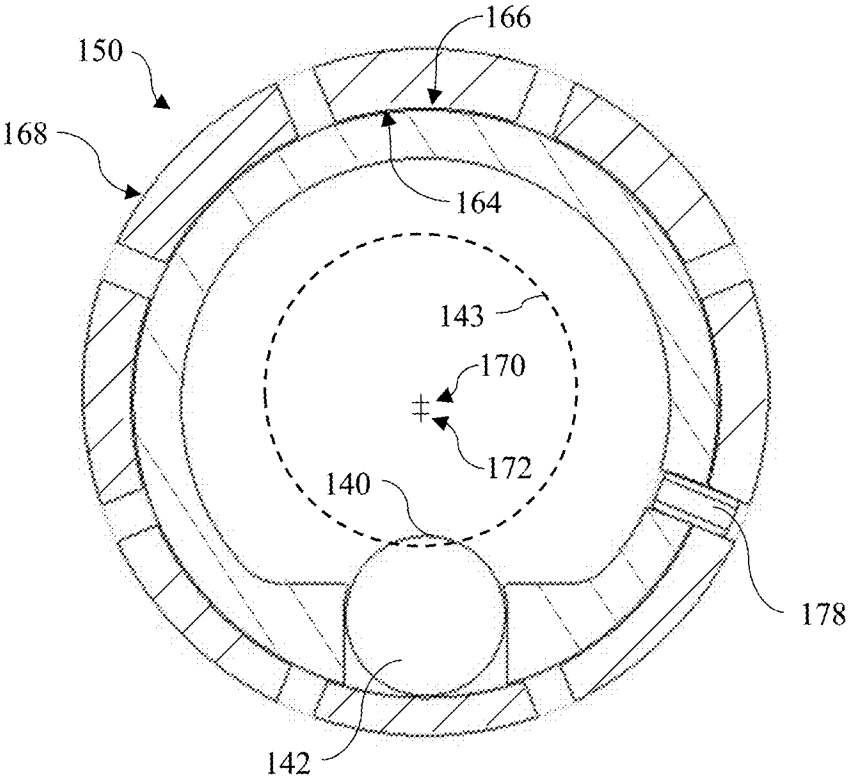
FIG. 18 is a cross sectional view of the sleeve of FIG. 16, with an inner body positioned relative to an outer body of the sleeve in a first rotational orientation.

Referring to FIGS. 3 and 15, it is often advantageous to form a core having a particular diameter. For example, conventional impregnated drill bit crowns can include sets of rectangular carbide inserts (e.g., pins) mechanically retained on the inner diameter gauge by a furnaced layer of backing powder below the crown matrix powder. These conventional impregnated drill bit crowns can be difficult to manufacture consistently, and the pins can prematurely fall out, thereby leading to failure of the drill bit to form the core with the desired diameter. Accordingly, in some aspects, the drill bit 100 can comprise a first roller bearing that is configured to shave down. The drill bit can further comprise a separate breaking element 142 (e.g., a second roller bearing) that is axially spaced from the cutting face of the crown by a greater distance than the first roller bearing. The first roller bearing 147 can protrude transversely into the 3D projection 143 of the inner operative circumference 118 (from outside of the 3D projection 143) a first radial distance, and the breaking element 142 can protrude transversely into the 3D projection 143 of the inner operative circumference 118 (from outside of the 3D projection 143) a second radial distance that is greater than the first radial distance. The first radial distance can be selected to be less than the protrusion distance necessary to cause the core to break (and selected to provide the desired diameter of the core sample), whereas the second radial distance can be selected to be sufficient to cause the core to break. It is further contemplated that a plurality of roller bearings 147 can be longitudinally spaced, and can incrementally and sequentially shave down the core to the desired diameter. The first roller bearing 147 and the breaking element 142 can optionally be supported by the same sleeve 150 or by respective sleeves. In exemplary aspects, the disclosed drill bit crowns can exclude inner gauge pins (e.g., carbide inserts) as are conventionally provided in impregnated drill bit crowns.

It is contemplated that using the first roller bearing 147 to determine the outer diameter of the core sample can remove the sample-sizing function from the bit crown. In this way, the kerf of the crown can be reduced. Further, variance of surface speed at the face can be reduced (e.g., the difference between the speed of the outermost portion of the crown as compared to the inner-most portion of the crown, which is a function of the differing radii from the rotational center), thereby improving penetration rates and overall wear life of the crown.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A drill bit configured to form core segments during drilling, the drill bit having a central axis, the drill bit comprising:

a shank defining an inner bore;

a crown coupled to the shank, wherein the crown defines a cutting face and a core receiving slot that extends inwardly into the crown from the cutting face, wherein the crown defines an inner operative circumference; and a core break structure disposed within the shank, wherein the core break structure defines a core break surface that extends inwardly toward the central axis and intersects an imaginary 3D projection of the inner circumference projected along the central axis.

Aspect 2: The drill bit of aspect 1, wherein core break structure comprises a spherical element that defines the core break surface.

Aspect 3: The drill bit of aspect 2, wherein the drill bit comprises a sleeve that is received within the inner bore of the shank, wherein the sleeve defines a receptacle that receives at least a portion of the spherical element.

Aspect 4: The drill bit of aspect 3, wherein the sleeve defines at least one longitudinal channel that extends along the central axis.

Aspect 5: The drill bit of aspect 2, wherein the sleeve comprises an inner body and an outer body, wherein the inner body is configured to be received within the inner body in a plurality of rotational orientations, wherein a distance that the core break surface extends into the imaginary 3D projection is determined by a rotational orientation of the inner sleeve relative to the outer sleeve.

Aspect 6: The drill bit of aspect 5, further comprising a fastener that couples the first sleeve to the second sleeve and inhibits rotation therebetween.

Aspect 7: The drill bit of aspect 5, wherein the inner and outer bodies of the sleeve define complementary surfaces that permit receipt of the inner body with the outer body in a plurality of discrete, predetermined orientations, while inhibiting rotation of the inner body relative to the outer body from the predetermined orientations.

Aspect 8: The drill bit of any one of the preceding aspects, wherein the core break surface extends across only a portion of the 3D projection of the inner circumference projected along the central axis.

Aspect 9: The drill bit of any one of the preceding aspects, wherein the central axis does not extend through the core break surface.

Aspect 10: The drill bit of any one of the preceding aspects, wherein the drill bit is configured to couple to a drill rod having an inner bore that defines an inner bore diameter, wherein the core break surface is spaced from the cutting face by a predetermined distance, wherein the predetermined distance is selected to form core segments having a length that is less than the inner bore diameter of the drill rod.

Aspect 11: The drill bit of any one of the preceding aspects, wherein:

the crown defines an outer operative circumference, the crown defines at least one face channel, wherein each face channel of the at least one face channel extends between and is in communication with the core-receiving slot and the outer operative circumference of the crown, and the at least one face channel is configured to receive fluid flowing distally along the outer surface of the crown and deliver fluid from the outer surface of the crown to the core-receiving slot.

Aspect 12: The drill bit of aspect 11, wherein the crown defines a plurality of crown portions that extend axially along the central axis and define respective cutting face portions, wherein respective cutting face portions of plurality of crown portions cooperate to define the cutting face of the crown, wherein adjacent crown portions of the plurality of crown portions are spaced by respective face channels.

Aspect 13: The drill bit of any one of the preceding aspects, wherein the inner operative circumference has a diameter of at least 10 mm.

Aspect 14: The drill bit of one of the preceding aspects, wherein the core break surface extends into the 3D projection of the inner circumference projected along the central axis by less than 15% of the diameter of the inner operative circumference along a transverse axis that is perpendicular to the central axis.

Aspect 15: The drill bit of one of the preceding aspects, wherein the core break surface is spaced from the cutting face along the central axis by a length of from 100% of the diameter of the inner operative circumference to 200% of the diameter of the inner operative circumference.

Aspect 16: A drilling assembly comprising:

a drill rod defining an inner bore; and a drill bit as recited in any one of the preceding aspects, wherein the shank of the drill bit is threadedly coupled to the drill rod.

Aspect 17: The drilling assembly of aspect 16, wherein the drill bit comprises:

a spherical element that defines the core break surface; and a sleeve that is received within the inner bore of the shank, wherein the sleeve defines a receptacle that receives therein at least a portion of the spherical element, wherein the drill rod biases against the sleeve.

Aspect 18: The drilling assembly of aspect 16 or aspect 17, wherein the drill rod has an inner bore that defines an inner bore diameter, wherein the core break surface is proximally spaced from the cutting face by a predetermined distance, wherein the predetermined distance is selected to form core segments having a length that is less than the inner bore diameter of the drill rod.

Aspect 19: A drilling assembly comprising:

a drill bit having a central axis, the drill bit comprising:

a shank defining an inner bore;

a crown coupled to the shank, wherein the crown defines a cutting face and a core receiving slot that extends inwardly into the crown from the cutting face, wherein the crown defines an inner operative circumference; and a drill string component coupled to the drill bit, wherein the drilling assembly comprises a core break structure that defines a core break surface that extends inwardly toward the central axis and intersects an imaginary 3D projection of the inner circumference projected along the central axis.

Aspect 20: The drilling assembly of aspect 19, wherein the core break structure is disposed within the shank of the bit.

Aspect 21: The drilling assembly of aspect 19, wherein the core break structure is disposed within the drill string component.

Aspect 22: A method comprising: advancing the drilling assembly of any one of aspects 13-18 into a formation to form drilling cuttings and core segments.

Aspect 23: The method of aspect 22, further comprising:

pumping fluid through an annular space between an outer surface of the drilling assembly and the formation; and collecting the core segments returning through the inner tube.

Aspect 24: The method of aspect 23, wherein collecting the core segments returning through the inner tube comprises filtering the core segments from the fluid.

Aspect 25: The method of aspect 24, further comprising: collecting the drilling cuttings returning through the inner tube by filtering the drilling cuttings from the fluid.

Aspect 26: The method of aspect 25, wherein the steps of filtering the drilling cuttings from the fluid and filtering the core segments from the fluid are performed using the same filter.

Aspect 27: The method of aspect 26, wherein the steps of filtering the drilling cuttings from the fluid and filtering the core segments from the fluid are performed using separate filters.

Aspect 28: A drill bit configured to form core segments during drilling, the drill bit having a central axis, the drill bit comprising:

a shank defining an inner bore, wherein the shank defines at least one thread that is configured to couple to an outer tube of a dual tube drill rod;

a crown coupled to the shank, wherein the crown defines a cutting face and a core receiving slot that extends inwardly into the crown from the cutting face, wherein the crown defines an inner operative circumference;

a core break structure disposed within the shank, wherein the core break structure defines a core break surface that extends inwardly toward the central axis and intersects an imaginary 3D projection of the inner circumference projected along the central axis;

at least one axial conduit that is radially spaced from the central axis and extends through the drill bit to provide fluid communication from the shank to the cutting face;

at least one face channel that extends from the core receiving slot and intersects a respective axial conduit of the at least one axial conduit.

Aspect 29: The drill bit of aspect 28, wherein the crown defines an outer circumference, wherein at least one of the at least one face channel extends to the outer operative circumference.

Aspect 30: A system comprising:

the drill bit of aspect 28 or aspect 29;

a drill string comprising at least one dual tube drill rod, wherein the at least one dual tube drill rod comprises:

an outer tube, an inner tube defining an inner pathway, wherein the at least one dual tube drill rod defines an annular space between the outer tube and the inner tube, wherein the outer tube is coupled to the at least one thread of the shank of the drill bit.

Aspect 31: The system of aspect 30, further comprising a sub that is coupled to the drill bit and the inner tube of the at least one dual tube drill rod, wherein the sub defines a portion of a flow path from the annular space to the crown and from the core receiving slot to the inner pathway.

Aspect 32: The system of aspect 31, wherein the drill bit defines a recess that receives the core break structure, wherein the sub biases against the core break structure to retain the core break structure within the recess.

Although the foregoing invention has been described in some detail by way of illustration and example for purposes of clarity of understanding, certain changes and modifications may be practiced within the scope of the appended claims.

What is claimed is:

1. A drill bit configured to form core segments during drilling, the drill bit having a central axis, the drill bit comprising:

a shank defining an inner bore;

a crown coupled to the shank, wherein the crown defines a cutting face and a core receiving slot that extends inwardly into the crown from the cutting face, wherein the crown defines an inner operative circumference;

a core break structure disposed within the shank, wherein the core break structure defines a core break surface that extends inwardly toward the central axis and intersects an imaginary 3D projection of the inner circumference projected along the central axis, wherein the core break structure comprises a spherical element that defines the core break structure; and a sleeve that is received within the inner bore of the shank, wherein the sleeve defines a receptacle that receives at least a portion of the spherical element, wherein the sleeve comprises an inner body and an outer body, wherein the inner body is configured to be received within the outer body in a plurality of rotational orientations, wherein a distance that the core break surface extends into the imaginary 3D projection is determined by a rotational orientation of the inner body relative to the outer body.

2. The drill bit of claim 1, wherein the sleeve defines at least one longitudinal channel that extends along the central axis.

3. The drill bit of claim 1, further comprising a fastener that couples the inner body to the outer body and inhibits rotation therebetween.

4. The drill bit of claim 1, wherein the inner and outer bodies of the sleeve define complementary surfaces that permit receipt of the inner body with the outer body in a plurality of discrete, predetermined orientations, while inhibiting rotation of the inner body relative to the outer body from the predetermined orientations.

5. The drill bit of claim 1, wherein the core break surface extends across only a portion of the 3D projection of the inner circumference projected along the central axis.

6. The drill bit of claim 1, wherein the central axis does not extend through the core break surface.

7. The drill bit of claim 1, wherein the drill bit is configured to couple to a drill rod having an inner bore that defines an inner bore diameter, wherein the core break surface is spaced from the cutting face by a predetermined distance, wherein the predetermined distance is selected to form core segments having a length that is less than the inner bore diameter of the drill rod.

8. The drill bit of claim 1, wherein:

the crown defines an outer operative circumference, the crown defines at least one face channel, wherein each face channel of the at least one face channel extends between and is in communication with the core-receiving slot and the outer operative circumference of the crown, and the at least one face channel is configured to receive fluid flowing distally along an outer surface of the crown and deliver fluid from the outer surface of the crown to the core-receiving slot.

9. The drill bit of claim 8, wherein the crown defines a plurality of crown portions that extend axially along the central axis and define respective cutting face portions, wherein respective cutting face portions of plurality of crown portions cooperate to define the cutting face of the crown, wherein adjacent crown portions of the plurality of crown portions are spaced by respective face channels.

10. The drill bit of claim 1, wherein the inner operative circumference has a diameter of at least 10 mm.

11. The drill bit of claim 1, wherein the core break surface extends into the 3D projection of the inner circumference projected along the central axis by less than 15% of a diameter of the inner operative circumference along a transverse axis that is perpendicular to the central axis.

12. The drill bit of claim 1, wherein the core break surface is spaced from the cutting face along the central axis by a length of from 100% of a diameter of the inner operative circumference to 200% of the diameter of the inner operative circumference.

13. A drilling assembly comprising:

a drill rod defining an inner bore; and a drill bit configured to form core segments during drilling, the drill bit having a central axis, the drill bit comprising:

a shank defining an inner bore;

a crown coupled to the shank, wherein the crown defines a cutting face and a core receiving slot that extends inwardly into the crown from the cutting face, wherein the crown defines an inner operative circumference;

a core break structure disposed within the shank, wherein the core break structure defines a core break surface that extends inwardly toward the central axis and intersects an imaginary 3D projection of the inner circumference projected along the central axis, wherein the core break structure comprises a spherical element that defines the core break surface; and a sleeve that is received within the inner bore of the shank, wherein the sleeve defines a receptacle that receives at least a portion of the spherical element, wherein the shank of the drill bit is threadedly coupled to the drill rod, and wherein the drill rod biases against the sleeve.

14. The drilling assembly of claim 13, wherein the drill rod has an inner bore that defines an inner bore diameter, wherein the core break surface is proximally spaced from the cutting face by a predetermined distance, wherein the predetermined distance is selected to form core segments having a length that is less than the inner bore diameter of the drill rod.

15. A method comprising: advancing the drilling assembly of claim 13 into a formation to form drilling cuttings and core segments.

16. The method of claim 15, further comprising:

pumping fluid through an annular space between an outer surface of the drilling assembly and the formation; and collecting the core segments returning through the inner bore of the drill rod.

* * * * *